US010456614B1

(12) United States Patent
Dube et al.

(10) Patent No.: US 10,456,614 B1
(45) Date of Patent: Oct. 29, 2019

(54) APPARATUS AND METHOD FOR DELIVERY OF AN ASSISTIVE FORCE FOR REHABILITATION/THERAPY AND WEIGHT TRAINING EXERCISE MACHINES AND STANDS

(71) Applicant: Omegamax Holding Company, LLC, Royersford, PA (US)

(72) Inventors: Leonard A. Dube, Exton, PA (US); Jason D. Griggs, Royersford, PA (US); Matthew Cubbler, Royersford, PA (US); Glenn R. Siegele, Pottstown, PA (US)

(73) Assignee: Omegamax Holding Company, LLC, Royersford, PA (US)

( * ) Notice: Subject to any disclaimer, the term of this patent is extended or adjusted under 35 U.S.C. 154(b) by 652 days.

(21) Appl. No.: 14/930,199

(22) Filed: Nov. 2, 2015

Related U.S. Application Data

(63) Continuation-in-part of application No. 14/537,976, filed on Nov. 11, 2014, now Pat. No. 9,174,086, and a continuation-in-part of application No. 13/840,150, filed on Mar. 15, 2013, now Pat. No. 8,900,097.

(60) Provisional application No. 62/095,139, filed on Dec. 22, 2014.

(51) Int. Cl.

| | |
|---|---|
| ***A63B 21/005*** | (2006.01) |
| ***A63B 21/062*** | (2006.01) |
| ***A63B 24/00*** | (2006.01) |

(52) U.S. Cl.
CPC ..... *A63B 21/0058* (2013.01); *A63B 21/062* (2013.01); *A63B 2024/009* (2013.01)

(58) Field of Classification Search
CPC ..... A63B 2024/009; A63B 21/0058; A63B 21/062
See application file for complete search history.

(56) References Cited

U.S. PATENT DOCUMENTS

| | | | |
|---|---|---|---|
| 4,765,611 | A | 8/1988 | MacMillan |
| 4,988,095 | A | 1/1991 | Ferrari |
| 5,058,888 | A | 10/1991 | Walker et al. |
| D325,610 | S | 4/1992 | Walker et al. |
| 5,147,263 | A | 9/1992 | Mueller |
| 5,209,715 | A | 5/1993 | Walker et al. |
| 5,230,672 | A | 7/1993 | Brown et al. |

(Continued)

OTHER PUBLICATIONS

The Barwis Method® MaxOut Tower User Manual from www.maxoutcorp.com, 21 pages, copyright 2013.

*Primary Examiner* — Sundhara M Ganesan
(74) *Attorney, Agent, or Firm* — Panitch Schwarze Belisario & Nadel LLP

(57) ABSTRACT

A motorized assist apparatus provides an assist force to user moved weight of a weight training or rehabilitation/therapy exercise machine or stand and includes an assist force delivery assembly with operably connected motor and reel, a flexible assist member on the reel to transmit force from the assembly to a primary load interface (PLI). A main digital controller controls operation of the assembly and a human-machine interface (HMI) accepts input of variable parameters for assist control. In some examples, the PLI is a harness to support a rehabbing person. In some examples, the motor can be a DC servo motor or an AC induction motor. In some examples, the assist assembly has two or more motors connected to drive the reel.

18 Claims, 17 Drawing Sheets

(56) References Cited

U.S. PATENT DOCUMENTS 5,254,885 A 10/1993 Ando
5,476,428 A 12/1995 Potash et al.
5,569,121 A * 10/1996 Sellier ..... A63B 21/0058 318/806
5,653,666 A 8/1997 Pantoleon
6,375,598 B1 4/2002 Frame et al.
6,447,431 B1 9/2002 Milburn et al.
6,558,299 B1 5/2003 Slattery
6,774,885 B1 8/2004 Even-Zohar
7,871,355 B2 1/2011 Yeh
7,963,886 B1 6/2011 Schwinn et al.
7,998,038 B2 8/2011 Keiser
8,727,946 B2 5/2014 Greenhill et al.
8,900,097 B1 12/2014 Griggs et al.
9,174,086 B1 11/2015 Griggs et al.
9,327,161 B1 * 5/2016 Maher ..... A63B 21/078
9,801,775 B2 * 10/2017 Vallery ..... A61H 3/008
2005/0233871 A1 10/2005 Anders et al.
2006/0094571 A1 5/2006 Polidi
2008/0176713 A1 7/2008 Olivera Brizzio et al.
2011/0165995 A1 7/2011 Paulus et al.
2011/0165996 A1 7/2011 Paulus et al.
2011/0165997 A1 7/2011 Reich et al.
2011/0172058 A1 7/2011 Deaconu et al.
2011/0195819 A1 8/2011 Shaw et al.
2012/0058859 A1 * 3/2012 Elsom-Cook .... A63B 21/00181 482/4
2012/0190502 A1 7/2012 Paulus et al.
2013/0116604 A1 * 5/2013 Morilla ..... A61G 7/1015 601/33
2013/0267384 A1 * 10/2013 Eldridge ..... A63B 24/0087 482/5
2014/0201905 A1 * 7/2014 Glukhovsky ..... A61G 7/1001 5/81.1 R
2014/0201906 A1 * 7/2014 Erturk ..... A61G 7/1001 5/81.1 R
2014/0206503 A1 * 7/2014 Stockmaster ..... A61H 3/008 482/4
2015/0320632 A1 * 11/2015 Vallery ..... A61H 3/008 482/69
2016/0151675 A1 * 6/2016 Chazalon ..... A63B 21/0053 482/5

* cited by examiner

APPARATUS AND METHOD FOR DELIVERY OF AN ASSISTIVE FORCE FOR REHABILITATION/THERAPY AND WEIGHT TRAINING EXERCISE MACHINES AND STANDS

CROSS-REFERENCE TO RELATED APPLICATION

This application is a continuation in part of and claims priority to U.S. patent application Ser. No. 13/840,150 filed Mar. 15, 2013, now U.S. Pat. No. 8,900,097, and Ser. No. 14/537,976 filed Nov. 11, 2014, now U.S. Pat. No. 9,174,086, and is related to U.S. Patent Publication No. 62/095,139, filed Dec. 22, 2014, all of which are incorporated by reference herein.

BACKGROUND OF THE INVENTION

The use of motorized exercise or rehabilitation equipment to generate resistive loads for a user and obviate the need for weights are well known. While some motorized resistive systems can be operated to vary the resistive load during certain portions of an exercise cycle and thereby effectively provide an equivalent of assistance, there are some experts who believe that the use of actual weights in training or rehabilitation, with assistance for portions of the exercise, achieves a superior result.

Apparatus to generate assistive loads for a user moving a primary load of weight(s) for weight training or rehabilitation/physical therapy exercise are much less common due to the more numerous and different problems encountered from mounting to control when compared to resistive force systems. U.S. Pat. No. 4,765,611 describes an early hydro-mechanical assistive system that employs counter weights to reduce the primary weight load sustained by a user. All known motorized assistive force apparatus have employed similar counter weight stacks, mounted in their own frames, making such devices quite bulky and heavy. These devise operate by supporting a counter weight stack until assistance is needed and then suddenly removing the support of all or a portion of the stack by a motor and then returning the support to the entire stack at the appropriate time in the exercise cycle. Such systems use common, non-servo motors that are operated at full torque output when powered and typically controlled for "bang-bang" on/off operation by the use of position switches or proximity detectors without variable control between the switches or detector.

BACKGROUND OF THE INVENTION

In one aspect, the invention is an assist apparatus for delivering an assist force to a human subject at a rehabilitation/therapy exercise station comprising: a motorized assist assembly including a motor driven reel, the assembly configured to generate a non-zero assist force through the reel; a flexible assist member having first and second opposing ends, the first end being secured to the reel so as to permit the member to be wound onto and from the reel by operation of the motorized assist assembly; a harness configured to support the human subject, the harness being operably connected to the second end of the flexible assist member to apply the assist force generated by the motorized assist assembly to a human subject in the harness; a human-machine interface configured to receive human input of variable parameters for assistance control including entry of at least a user selected non-zero assist force; and a main digital controller operably connected with at least the motorized assist assembly and the human-machine interface, the main digital controller being programmed to convert the user selected non-zero assist force into control signals suitable to operate the motorized assist assembly to provide the user selected non-zero assist force through the flexible assist member and harness to at least partially support the weight of the human subject during exercise.

In another aspect, the invention is a method of using the of operating the aforesaid assist apparatus comprising the steps of: initially securing the second end of the flexible assist member with the harness being worn by the user; and thereafter using the motorized assist assembly to apply the assist force to the harness with the user, the assist force being less than the weight of the harness wearing user, so as to assist the user to stand.

In another aspect, the invention is assist apparatus for delivering an assist force to user moved weight of a strength training or rehabilitation exercise station comprising: an assist assembly including a non-servo, AC induction motor having an output shaft and a reel drivingly connected with the output shaft so as to be rotated by the motor; a flexible assist member having first and second opposing ends, the first end being configured to be secured to the reel so as to permit the member to be wound onto and from the reel by operation of the motor and the second end being configured to be coupled directly or indirectly with the user moved weight; a human-machine interface configured to receive human input of variable parameters for assistance control including entry of at least a user selected non-zero assist force; a sensor providing data indicating at least one of rotational position and speed of the reel, current being supplied to the motor, torque being output by the motor and tension in the flexible assist member; and a main digital controller operably connected with the sensor and being preprogrammed with a Position-Integral-Derivative algorithm to convert the user selected non-zero assist force into control signals suitable to operate the motor to provide the user selected non-zero assist force through the flexible assist member during at least portions of an exercise set having repeated consecutive concentric and eccentric movement portions.

In another aspect, the invention is a method of operating the aforesaid assist apparatus comprising the steps of: initially securing the second end of the flexible assist member with a user moved primary load interface of the station; thereafter generating the user selected non-zero assist force with the assist assembly and supplying that assist force to the primarily load interface with the flexible assist member at least during concentric movement portions of an exercise set having a repeated sequence of concentric and eccentric exercise portions; and generating the non-zero static force with the assist assembly and supplying the no-zero static force to the primary load interface with the flexible assist member at least during some eccentric portions of the exercise set.

In still another aspect, the invention is an assist apparatus for delivering an assist force to user moved weight of an exercise or rehabilitation station comprising: a motorized assist assembly including first and second motors drivingly connected with a shaft and a reel fixedly supported on the shaft so as to be rotated by the first and second motors; a flexible assist member having first and second opposing ends, the first end being configured to be secured to the reel so as to permit the member to be wound onto and from the reel by operation of the motorized assist assembly and the second end being configured to be coupled directly or indirectly with the user moved weight; a human-machine interface configured to receive human input of variable parameters for assistance control including entry of at least a selected non-zero assist force; and a main digital controller operably connected with at least the motorized assist assembly and the human-machine interface, the main digital controller being preprogrammed to convert the user selected non-zero assist force into control signals suitable to operate the motorized assist assembly to provide the user selected non-zero assist force through the flexible assist member during portions of an exercise set having repeated consecutive concentric and eccentric movements

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

DETAILED DESCRIPTION OF THE INVENTION

Figure 1:
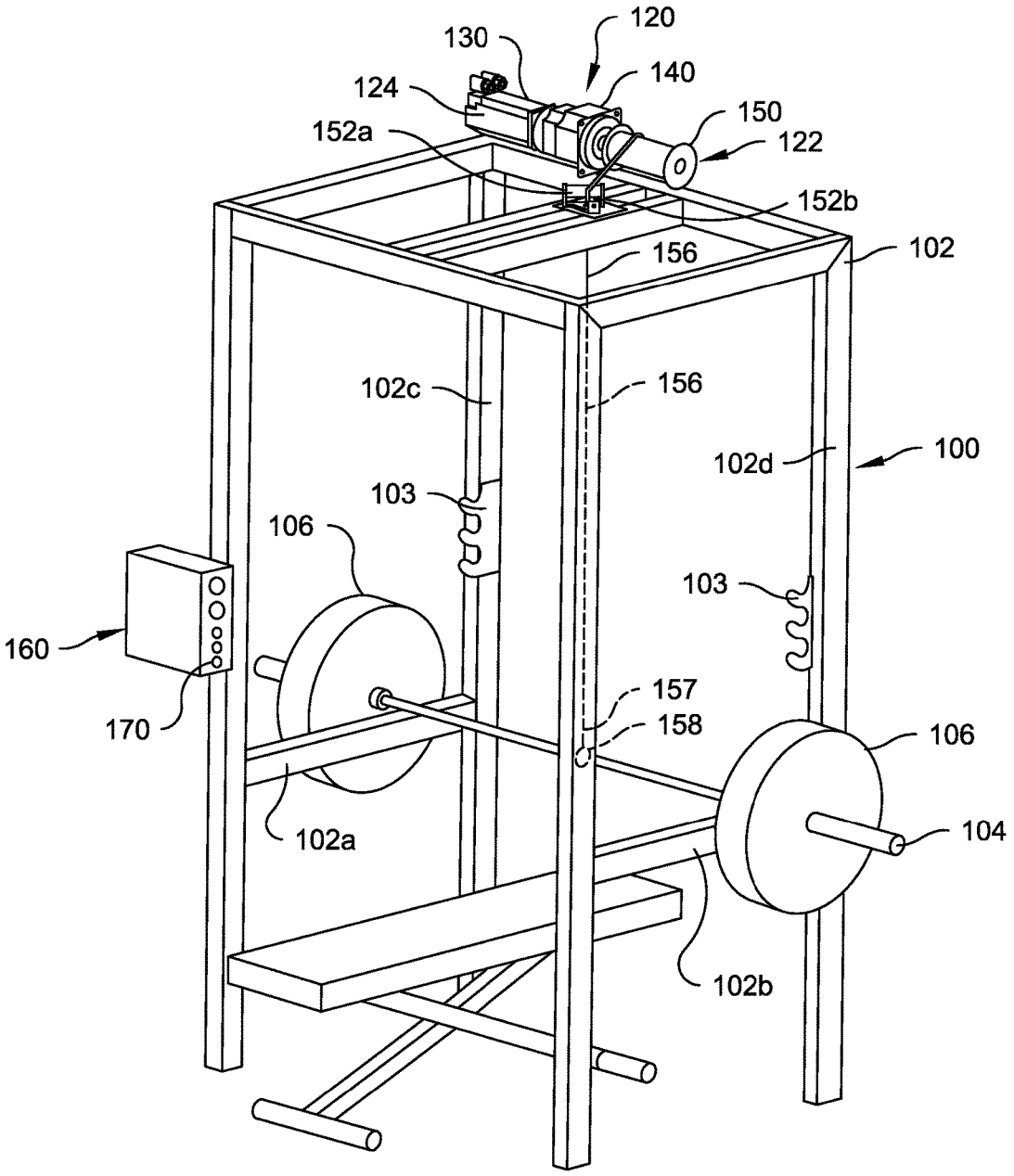
FIG. 1 depicts an exercise device combined with a motorized assist force delivery apparatus of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the stated component and designated parts thereof. The terminology includes the words above specifically mentioned, derivatives thereof and words of similar import.

Assist Force refers to a force applied to a primary load interface (PLI) for the purpose of reducing the net effective load otherwise being provided to the PLI by an unopposed/unassisted primary variable load (PVL), the user moved load. An assist force may be constant or vary over time and/or position of the primary load interface.

Concentric Movement refers to that portion of the cyclic or repetitive motion of an exercise where the targeted muscle group continually contracts while the weight is in motion from a start position to a finish position, the latter being the concentric range limit. Examples include a classic bench-press, performed from a supine position, where the weight bar is moved from the starting position at the chest upward to the arms-extended finish position or, in a squat exercise, where the weight is moved from a squat position to a standing position.

Concentric Range Limit is a pre-determined position of travel for the PLI that defines the completion of the concentric movement.

Eccentric Movement is the complement of the concentric movement defined above, where the weight in a free weight resistive exercise is returned to its starting position, usually at or near an eccentric range limit. The targeted muscle group is progressively extended and relaxed from full contraction at the concentric endpoint/range limit back to a starting point of the next concentric movement, where it is mostly or completely relaxed.

Eccentric Range Limit is a pre-determined position of travel for the PLI that establishes the completion of the eccentric movement. This may be the same as, or slightly different than, the original rest or start position of the PLI before the beginning of a set of exercise repetitions.

Human Machine Interface (HMI) is a device or collection of devices which allows a person to control the operation of the assist system, i.e., turn on/off, start/stop/pause, enter parameters of the exercise and, depending on system complexity, also communicate with, i.e., receive/retrieve/view information from, install or modify program instructions for, and/or perform limited troubleshooting on the system. In its most rudimentary form an HMI may be individual switches with one or more conventional manual actuators (push buttons, dials, etc.). In a more sophisticated implementation, an HMI might also include a visual display and keyboard or touch-screen computer display.

Lower Safety Limit refers to a physical position limit established for certain free weight exercise movements such as a bench press below which the PLI will not be allowed to move, so as to protect the subject from physical harm. This is usually set at or slightly below the eccentric range limit.

Primary Load Interface (PLI) is a mechanical medium to which is applied the Primary Variable Load or PVL and with which the exercising subject would make physical contact and usually intend to move to move the PVL. The PVL may be mechanically affixed directly to the PLI (i.e. plates on a bar grabbed by the user) or via other connective media such as a cable or hydraulic linkage, etc. Examples of the latter include a leg press machine having a movable plate or platform against which the user would push with his feet or most weight stack/pin select machines that normally employ a cable and handle PLI between the PVL weight stack and the user.

Primary Variable Load (PVL) is the primary weight, load or opposing force which is applied to a Primary Load Interface, and which must be matched or exceeded during an exercise by a subject to be moved by the subject and which, by design of the system or machine providing the load, is not constrained to be a single permanent value. A common example would be variations of multiple weight plates that may be loaded onto a bar or in a pulley-cable plate system wherein placement of a movable connecting pin within a stack of plates determines a specific quantity of plates and thus the amount of weight to be hoisted by movement of the cable.

Repetition or Rep refers to a complete movement cycle comprised of both a concentric and eccentric movement.

Servo Motor is a specialized form of electrical motor where the physical position of the output device, normally a spinning shaft, can be controlled as a function of time. Servo motors are typically used in a closed loop architecture such that one or more internal and/or sometime external feedback sensors are used to confirm that the motor is in the desired position, or at the desired velocity or torque. As used herein, an integrated servo motor has at least a self-contained sensor such as an angular encoder which may divide a complete 360° revolution of the output shaft into tens of thousands, or even millions of discrete locations and output a position signal for use in controlling the operation of the motor. A feature of servo motors is that, when properly sized, they are practicably insensitive to the loads resisting their movement and are able to satisfy the position-time demand by essentially varying the electric current they draw from the source as needed, in real time, to provide sufficient power to match or overcome any dynamic load variation. (Motor "size" refers to its maximum torque output.) This ability of a servo-motor to vary current draw introduces resultant motor torque itself as an alternate controllable output parameter, in addition to position. Since current relates to power directly as $$P=V\times I \text{ (voltage times current)}$$

when applied to a rotating shaft of known radius, a known output torque is also then available, and correlates directly with current draw. Servo motors may thus be commanded to move to known positions or, known positions as a function of time (which correlates to various velocity and acceleration profiles) or, alternately, to maintain a specific power production which then correlates to a constant applied force or, to vary the power production as a function of time or in real-time response to a system's, or a person's demand.

Servo Motor Drive is a type of electric motor drive that accepts power demand input signals from a separate controller and uses those signals to then vary the current being fed to the servo motor under control of the drive. A servo motor drive might receive digitized instructions from a processor to move the servo-motor to a specific position at a specific time or, when continuous motion is desired, a continuous stream of successive positions over successive points in time or, a series of discrete command sets such that the motor output shaft can be varied infinitely along a time continuum to create non-linear speed, acceleration and motion profiles. It can also supply current at a predetermined level to generate a selected output torque, regardless of angular position of the armature.

Station will encompass strength training and rehabilitation/therapy machines and stands employing weights, the latter typically being nothing more than a frame to support a weighted bar prior to and after use. As will be explained, it may be a stand or machine supporting a rehabilitation/therapy patient.

User Force refers to an amount of force generated by a subject contracting an active, and directly controllable muscle or muscle group, often associated with a moveable limb or limbs and commonly during an exercise repetition. Depending on the physical constraints of the PLI and/or the magnitude of the PVL relative to the user force, the PLI may or may not move.

Apparatus and methods of the present invention are designed to provide an Assistive Force to a user Primary Load Interface supporting or connected with a Primary Variable Load (typically, free weights or weight stack in a machine) to supplement User Force during a Concentric portion of a repetitive exercise having Eccentric and Concentric portions moving the Primary Variable Load.

FIG. 1 depicts a free weight, bench press exercise stand 100 as might be retrofitted with the present invention and include a frame 102, a primary load interface in the form of a bar 104, a primary variable load in the form of one or more pairs of disk weights 106 conventionally mounted on either end of the bar. The frame 102 may be provided cross members 102*a*, 102*b* to provide rigidity and to define a lowermost mechanical stop below which the bar 104 will not pass. Sets of bar supports 103 fixedly mounted to upright beams 102*c*, 102*d* of the frame 102 higher than the cross members 102*a*, 102*b* provide selective bar start or rest positions where the user is expected to start and finish an exercise and store the bar between exercises.

A first embodiment motorized assist force delivery apparatus according to the present invention is indicated generally at 120 and is also preferably fixedly secured to the frame 102. Assist apparatus 120 preferably includes at least a servo motor 130 or equivalent rotary actuator, a gearbox 140 or equivalent transmission, and a reel 150. These components are fixedly connected together in a motorized, linear assistive force or simply "assist" assembly 122 for operation, the motor 130 driving the gear box 140 driving the reel 150. A flexible assist force member preferably in the form of a metallic cable 156, is wound around the reel 150. A first end of the cable 156 (hidden) is secured to the reel in a conventional fashion. The second or "free" end 157 is provided in a configuration for attachment directly or indirectly with the variable primary load 106, for example by the provision of mounting hardware 158 in the form of a clam shell clamp to be fixedly secured to the center of the primary load interface/bar 104. Additional hardware in the form of cable guides such as a pair of stacked rollers 152*a*, 152*b* may be installed arranged at right angles on the frame 102, to redirect the cable 156 from the reel 150 to a position vertically opposing the center of the primary variable load 106. The assembly 122 itself is also preferably fixedly secured in a horizontal orientation through mounting hardware such as a mounting platform 124 fixedly secured to the bottom of the motor 130, the platform 124 then being fixedly secured to the existing frame 102. Platform 124 is a box and provides a cantilever mounting of the assembly 122. Other platforms that might be used include an L shaped joined pair of mounting plates with holes for motor mounting at one end and holes along the remaining side for direct or indirect frame attachment. Another would be a C shaped set of three joined mounting plates where a second, end plate might be provided opposing the motor mounting end plate and provided with a bearing to receive the free end of a shaft extending from the distal end of the reel 150 to support the assembly at both ends. Conventional cable guides such as the crossed rollers 152*a*, 152*b* or pulley(s) to be described may also be provided. Conventional fasteners such as nuts and bolts, radiator clamps, screws (none depicted) are also preferably provided to permit removable mounting of the assembly 122 and remainder of the apparatus 120 to an existing frame 102 with a minimum assortment of tools and a minimum amount of site preparation.

Figure 2:
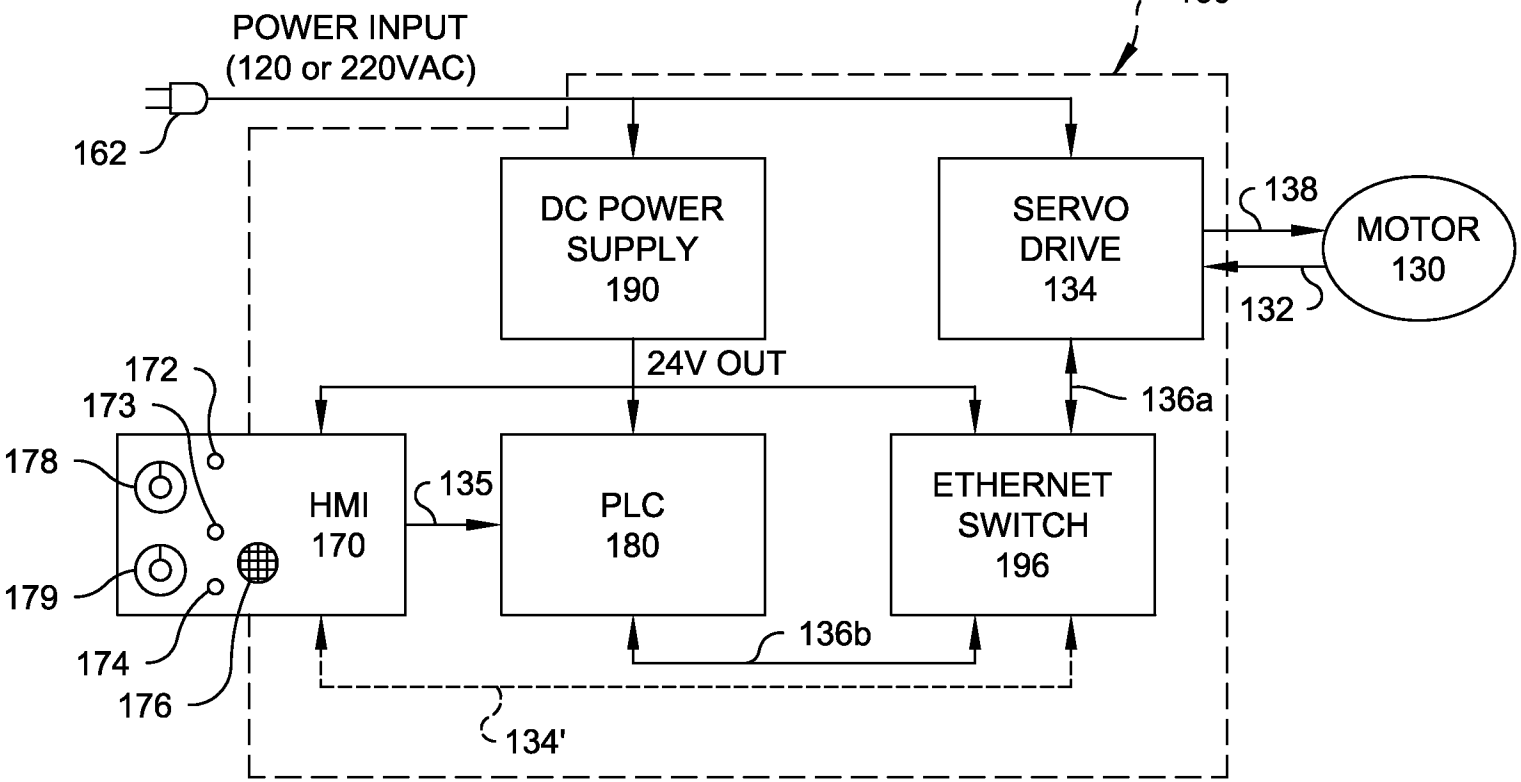
FIG. 2 is a block diagram of the electrical components of the apparatus of FIG. 1.

Electrical/electronic components of the apparatus 120 are best seen in the FIG. 2 block diagram. These depicted components provide a most basic form of the apparatus 120 and preferably include a human-machine interface (HMI) 170, a main digital controller 180, which in its simplest and least expensive form is suggestedly a programmable logic controller (PLC), a motor or "servo" motor drive 134, in particular, compatible with the selected servo motor and a DC power supply 190 to supply necessary DC power to the other circuitry from a conventional AC power source accessed through a plug 162. An Allen Bradley Kinetix servo drive 134 converts AC power into a higher voltage, DC signal that is modulated by the drive to vary the power supplied to the servo motor 130 on cable 138. The motor supplies an analog position signal back to the drive 134 on line 132 for control. The drive 134 converts that signal into a form the main digital controller/PLC 180 can use and preferably passes it to the main digital controller/PLC 180 through an Ethernet switch 196 along lines 136*a*, 136*b*. The main digital controller/PLC 180 returns control signals through Ethernet switch 196 and lines 136*a*, 136*b*, which the drive 134 implements through varying a signal it applies to the motor to power the motor. The main digital controller/PLC 180 is thus operably connected with the servo motor 130 through the servo drive 134, switch 196 and lines 132, 136*a*, 136*b* to receive at least angular position sensor data from the motor 130 and to supply control signals to the drive to variably control the amount of power supplied to the motor 130 along line 138.

The main digital controller/PLC 180 is further operably connected with the HMI 170 to receive user inputs to set up the apparatus 120 to provide a user selected assist force and to provide feedback to the user. Again, in its simplest form, the HMI 170 might be provided by a set of individual manual electromechanical actuators such as a multipurpose button or plurality of buttons 172, 173, 174 connected with momentary contact switches to start/stop the apparatus 120 and/or begin/end the exercise and permit the user to enter values such as concentric/eccentric range limits, respectively. Dials 178, 179 connected with angular encoders, rheostats or other conventional rotary output devices may be provided respectively for user entry of the amount of assist force to be generated (e.g. in pounds or kilograms), during the assist portion of the exercise cycle/repetition, and the number of repetitions to be performed. The latter would be desirable as on the last cycle of the exercise, when the user is most exhausted, assist would normally be removed as the user attempts to lower the bar 104 back to the supports 103 in what would be the beginning of an eccentric movement. By selecting a specific number of repetitions, the main digital controller/PLC 180 can be programmed to maintain assist after completion of the last scheduled concentric repetition. If a repetition selector feature is implemented, there should also be a control (such as a setting on the dial 179), which represents an unlimited number of reps so that the assist force is not applied after completion of any concentric movement. In such a component configured HMI, a direct/hard wire connection 135 is the most convenient. For higher level, digital HMI (as will be discussed later), connection with the main digital controller 180 might be two way through the Ethernet switch 196 and a line or channel 134'. A speaker 176 may be provided to squawk under command of the main digital controller/PLC 180 to signal entry of user selections, limits, beginning/end of exercise, approach of limits during a repetition, etc. These control components might be provided together in a single control box 160, that is also preferably configured to be fixedly secured to one or another member 102*f* of the existing frame 102 through suitably mounting hardware (again not depicted).

Use of a commercially available servo motor 130 provides particular advantages. Commercially available motors are already configured to permit one complete rotation of the armature to be divided into a million or more discrete points. The present application has no need for such fine resolution but a resolution of at least hundreds of points per full rotation are suggested and thousands of points are preferred. Furthermore, integrated servo motors have one or more built-in sensors including at least an absolute position encoder as well as non-volatile onboard memory so that as a motor armature spins hundreds or even thousands of revolutions away from its initial 'home' or 'zero' position, it would always know exactly where it is in relation to that origin and therefore how to get exactly back to its home position.

One suggested assembly 122 could be provided by an Allen Bradley MPL-A330P-MJ24AA servo motor 130 with a compatible Allen Bradley Kinetix™ 350 servo drive 134 and a Parker PEN090-005S7 gearbox 140 having a 5:1 reduction ratio rotating a four to six inch diameter reel 150. In the present type of use, the servo motor 130 would be called upon to make only a very limited number of revolutions, generally no more than twenty to thirty and typically no more than ten (converting into six to two revolutions of the reel 150 with the 5:1 reduction of the transmission) so that "growth" of the effective diameter of the reel 150 from gathering cable 156 would be immaterial. Other combinations of discrete motor, gearbox and reel can be specified to produce different ranges of assist. The beauty of servo motor/drive combinations like the aforesaid Allen Bradley pair is that they can be configured electronically for torque or position control and can be toggled electronically between the two as desired. For assist, torque control mode suggestedly would be used. The aforesaid Allen Bradley pair can provide up to one hundred lb.-feet of torque, which can be controlled on a percentage basis. Thus for ten lb.-feet output from the motor, the drive 136 can be commanded by the PLC 180 to operate the motor at ten percent. This enables simple generation of a constant output torque providing constant assist forces or more complicated time varying torque profiles for time varying assist force profiles.

Figure 3A:
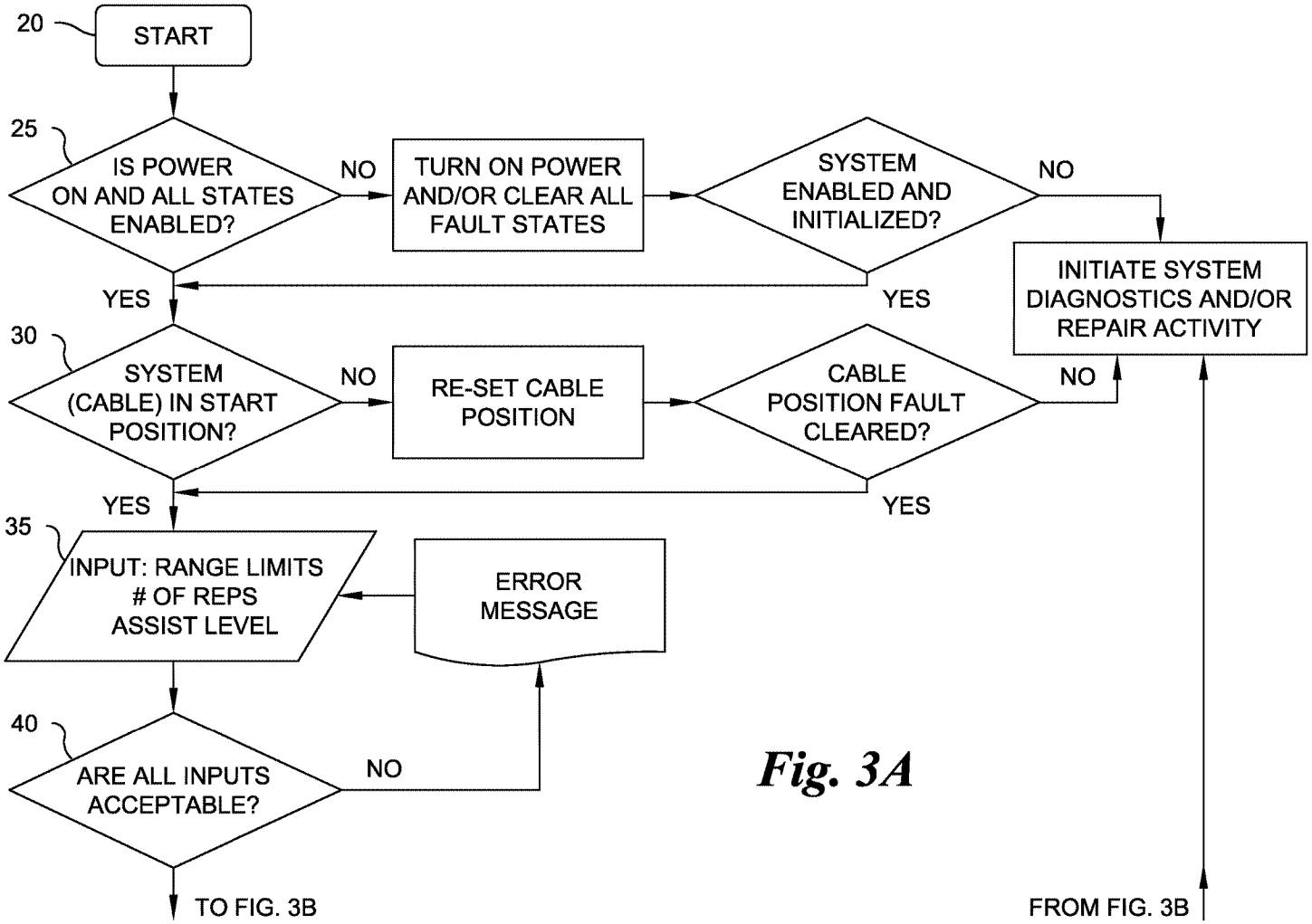
FIGS. 3A and 3B are a flow chart for operating the apparatus of FIGS. 1-2.
Figure 3B:
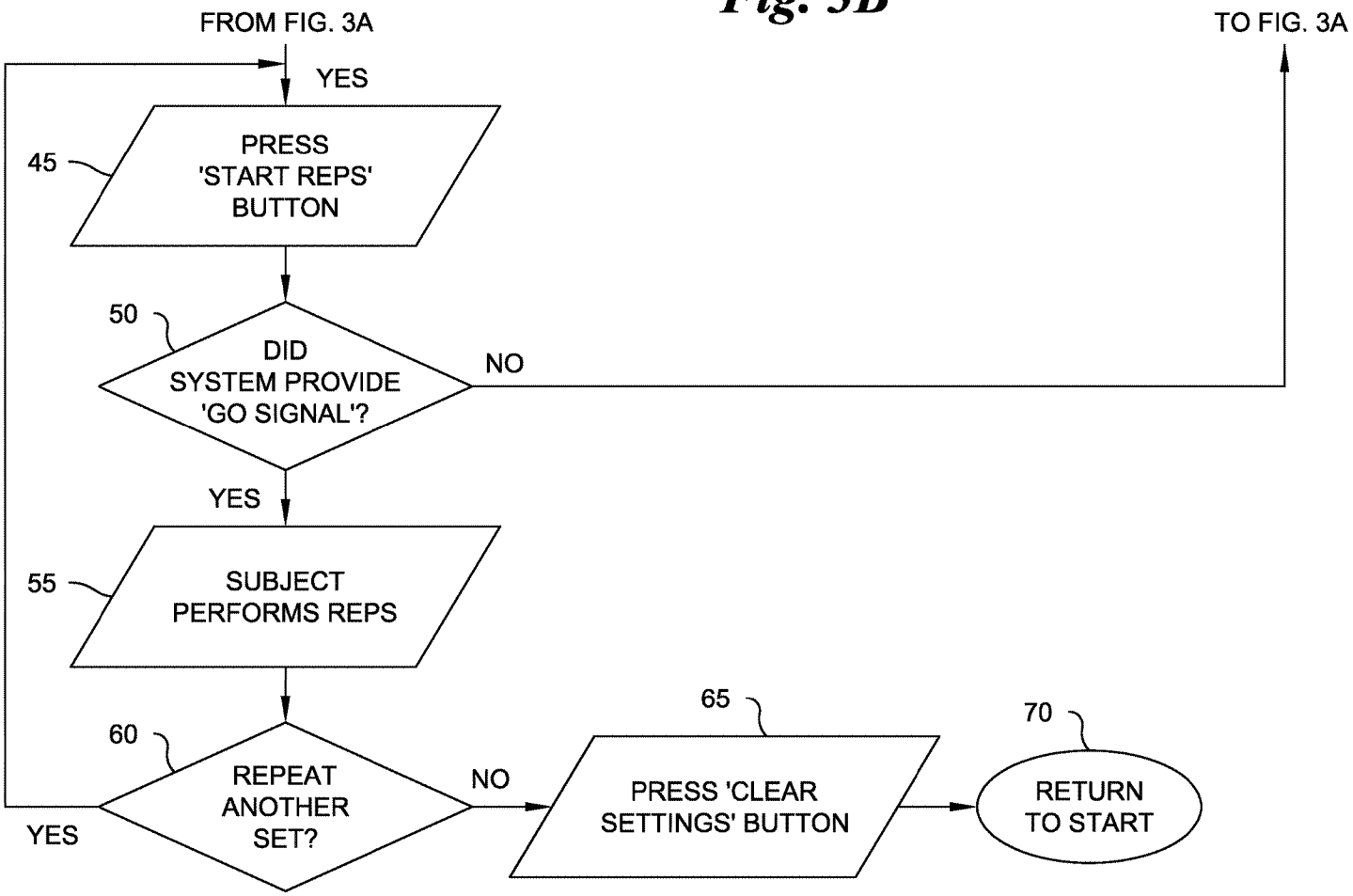

Operation of the most basic form of the apparatus 120 will now be explained reference to FIGS. 3A and 3B. Initialization of the apparatus 120 for operation is started at 20 by supplying electric power to apparatus 120 and hitting a START/BEGIN button 172. After completion of a programmed internal initialization cycle at 25, 30 of the main digital controller/PLC 180, that preferably includes the start or rest of the starting position of the bar on the supports 103, the user selected information is entered at 35. A user lies on the bench, removes an unweighted interface/bar 104 from the supports 103 and raises it to a desired extended upper position constituting the concentric range limit. An attendant/spotter depresses a second button 173 signaling the PLC 180 that this is the position of the cable at the desired upper/concentric range limit. Similarly, the user lowers the unweighted interface bar 104 to a desired lowermost position and the attendant/spotter depresses the third button 174 to signal the PLC 180 the position of cable at the desired lower/eccentric range limit. The PLC 180 is preferably programmed to hold the servo motor 130 at a modest torque level to maintain a minor static or drag load on the flexible assist member at least during this initialization process (and preferably whenever the apparatus is powered but not in use) sufficient to prevent the cable 156 from going slack or sagging, suggestedly no more than two pounds and preferably only a pound or less. The main digital controller/PLC 180 is preferably configured to store the start position of the bar 104 in the supports 103 and the upper and lower range limit positions of the bar 104 from position data supplied by the integral servo motor 130. Before or after entry of the upper and lower limits, an assist weight and a number of repetitions may be dialed in by the user or an assistant via dials 178, 179. After the primary variable load 106 has been added to the bar 104, the START/BEGIN button 172 is again depressed at 45 to signal start of the exercise to the main digital controller/PLC 180. The exercise cycle begins with the bar 104 in the starting position on a selected level of the bar supports 103. The main digital controller/PLC 180 may or may not be programmed to initially supply an assistive force as the bar 104 is raised from the starting position on the supports 103 to the upper/concentric range limit position. After reaching the upper/concentric range limit position, the user begins the eccentric movement portion of the exercise by lowering the bar 104 towards his chest. During this portion of the cycle, the main digital controller/PLC 180 is programmed to create only a very modest torque output from the motor 130 to provide a drag or static force that is preferably no more than is necessary to keep the cable 156 relatively taut (i.e., to prevent slack) as the bar 104 is lowered. When the main digital controller/PLC 180 recognizes that the bar 104 has reached the lower/eccentric range limit position of the cycle, the main digital controller/PLC 180 changes control signals to the servo drive 134 to supply greater power to the servo motor 130 to generate a greater torque sufficient to provide the user selected assist force at the free end 157 of the flexible assist member/cable 156. The assembly 122 provides the selected level of assist force as the bar 104 is raised during the concentric portion of the cycle or repetition. When the main digital controller/PLC 180 senses that the bar 104 has again reached the upper/concentric range limit position, it commands/controls the servo drive 134 to again reduce current to the motor 130 to essentially eliminate any significant assist force generated by the assembly 122 and cable 156 (other than the static/drag force) and the cycle is repeated until the dialed in number of repetitions have been performed and the exercise completed at 55. The START/BEGIN button 172 can again be depressed at 60 to start another repetition set or depressed again at 65 without bar movement to clear the system. The main digital controller/PLC 180 could be programmed with an algorithm to calculate a necessary power value to generate a level of torque necessary to provide the desired assist force at the end of the assist cable 156. However, with a limited number of discrete assist force values that might be selected by a user, the PLC 180 might simply be provided with a look-up table which contains the data necessary to generate the appropriate control signals to the servo drive 132 to generate the torque necessary to provide the selected assist force.

Even with this simple control system, the PLC 180 might be preprogrammed to include a lower safety limit position value that would not normally be changed and for which the servo drive would provide maximum torque in order to maintain PLI position. Furthermore, many servo motors (including the aforesaid Allen Bradley motor) are equipped with self-braking circuits, which will activate to attempt to maintain an armature position in the event of power loss. The assembly 122 might also or alternatively be provided with an electro-mechanical brake (not depicted) configured to engage some rotary portion of the assembly 122 or the cable 156 in the event of no power or loss of power, for example, one or more spring-loaded shoes or pads maintained disengaged by electromagnet(s). The main digital controller/PLC 180 can be programmed as an additional safety measure to monitor position and/or movement of the primary load interface/bar 104 to provide an assistive force if the bar is moved too quickly during an eccentric portion of a movement, indicating possible problems by the user, or if the bar remains stationary or nearly stationary in a position between limits where the bar should be moving, again indicating a possible problem with the user. Position output from the servo motor enables the provision of all of these features.

Furthermore, with sufficient memory, exercise parameters such as the concentric/eccentric range limit values, number of repetitions, etc. might be stored for access by the main digital controller/PLC 180 for repeated use and for multiple different users, as might a history of exercises for a given user. Programming and memory may also be provided to permit user identification to be entered as part of the initialization program, for example through the provision of a number key pad, touch screen or a swipe reader, which would result in the last set or some other pre-stored set of exercise parameters being entered automatically for the indentified user.

Figure 4:
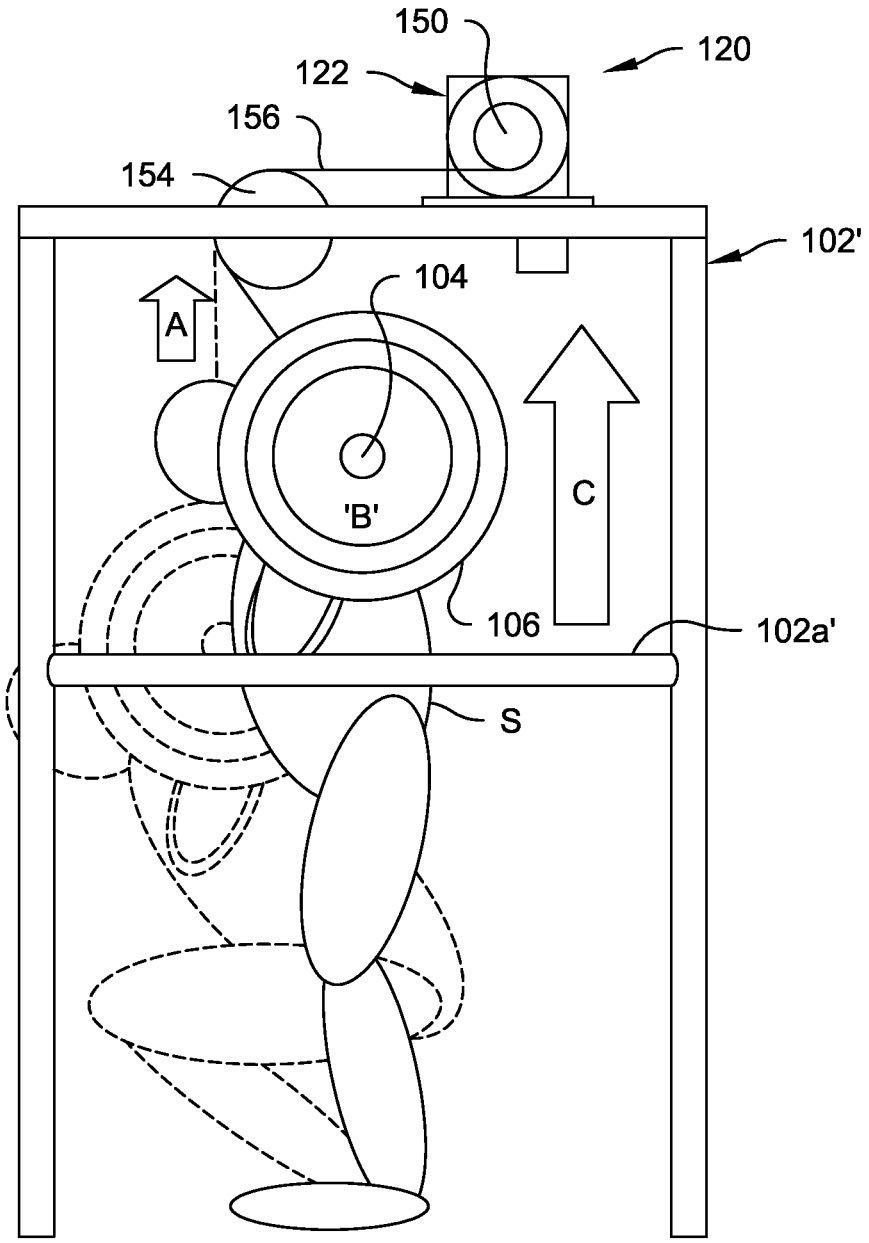
FIG. 4 illustrates diagrammatically a slightly different mounting and arrangement of the motorized assist force delivery apparatus of FIG. 1 in a first, "concentric" movement of a squat exercise.
Figure 5:
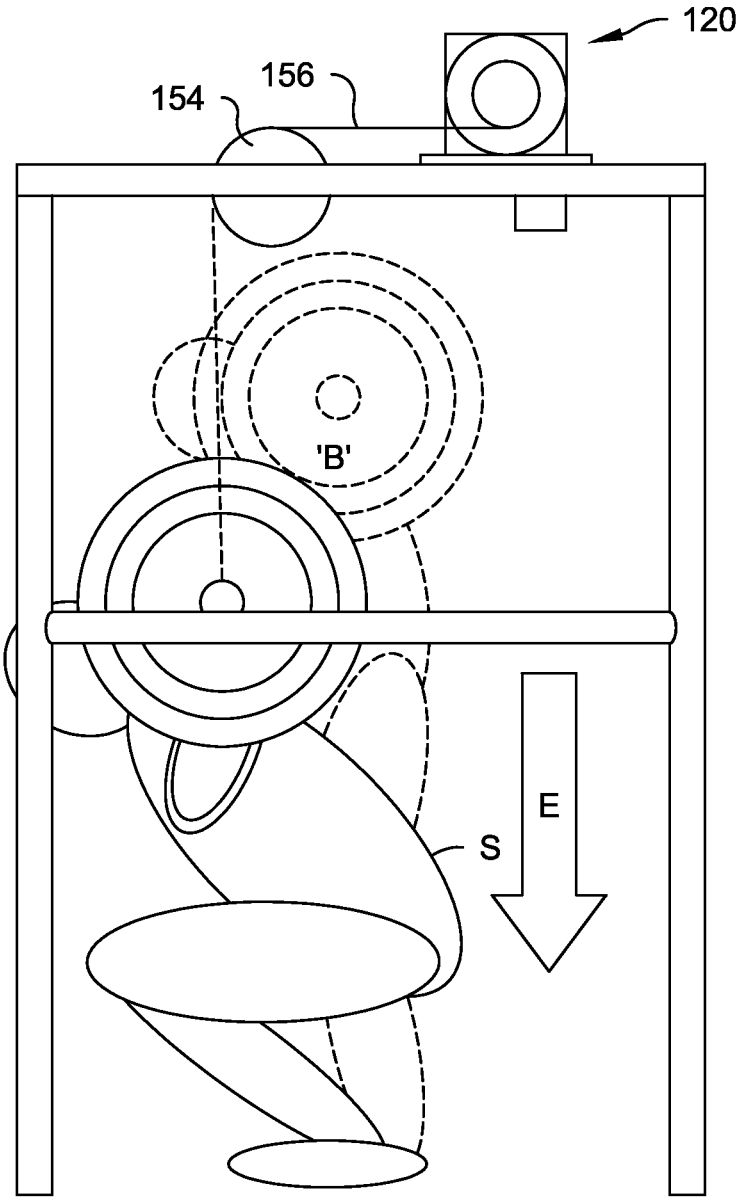
FIG. 5 illustrates diagrammatically the apparatus of FIG. 4 in a second, "eccentric" movement of the squat exercise.

FIGS. 4-5 illustrates diagrammatically a slightly different mounting and arrangement of the assistive force delivery apparatus 120 of FIG. 1 for a squat exercise stand. Referring to the figures, it will be seen initially that the original cable guides in the form of crossed rollers 152*a*, 152*b* of the first installation of FIG. 1 have been replaced by a fixed position pulley 154. In this set-up, the exercise begins with the bar 104 in a lowermost position resting on cross members 102*a*' of the frame 102' but supports 103 like those in the bench press stand 100 might be provided. Initial limit position values, selected assist force, number of repetition and similar data would be entered as before and the exercise begun. In this configuration, an assist force A is supplied immediately by the assembly 122 as the subject S straightens up and raises the bar 104 and load 106 during the concentric movement portion of the cycle (phantom lower to solid upper positions in FIG. 4). When the main digital controller/PLC 180 senses the bar 104 has reached the upper/concentric range limit position (solid subject S in FIG. 4 and phantom in FIG. 5), the assist force is again effectively removed as the subject S descends into a squat position (phantom in FIG. 4, solid in FIG. 5) until the lower/eccentric range limit position is again reached, in response to which the main digital controller/PLC 180 regenerates the selected assist force A for the next concentric movement portion of the exercise.

Figure 6:
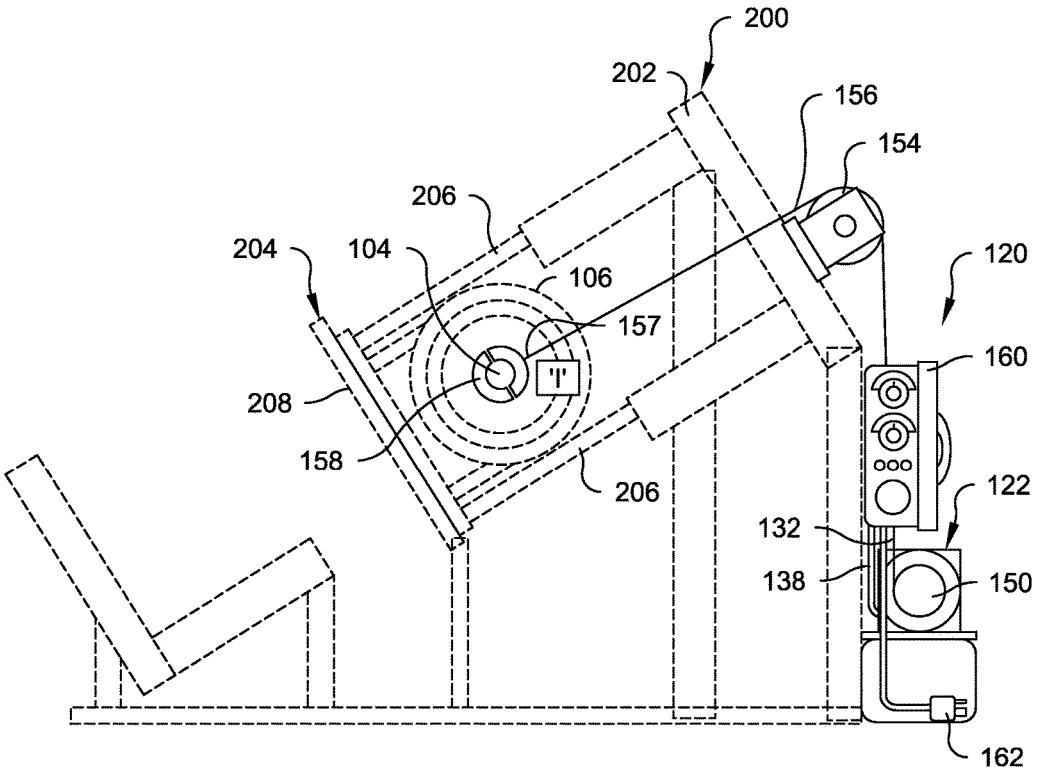
FIG. 6 illustrates diagrammatically another slightly different mounting and arrangement of the assist force delivery apparatus of FIG. 1 as it might be supplied in a kit or accessory and installed in a conventional, commercially available leg press machine.

FIG. 6 illustrates diagrammatically another possible installation of the assist apparatus 120 with another type of "free weight" exercise machine 200 for leg presses. Machine 200 includes a frame 202, a primary load interface in the form of a bar 104, a primary variable load in the form of one or more pairs of disk weights 106 conventionally mounted on either end of the bar. This particular machine 200 supports bar 104 on a sub-frame 204 itself supported on telescopic arms 206 for user movement by pushing a foot-plate 208 portion of the sub-frame 204. The assist apparatus 120 is secured to one or more members of the frame 202. Flexible assist member/cable 156 extends from reel 150 over a pulley 154 to a second end 157 where it is secured to the bar 104 via the clam shell clamp 158. The assembly 122 and control box 160 can be secured to one or another of the upright members of the frame 202. The load 106 and bar 104 are located at the eccentric-range limit position marking the eccentric to concentric transition.

It will be appreciated that the apparatus 120 might be supplied as a kit including the assist force assembly 122, assist force cable 156, cable redirection hardware such as rollers 152 and/or pulleys 154, control box 160 and related electrical connections 132, 136, 138, 162, etc. and conventional mounting hardware 147, 158, etc. for mounting to the circular or square tubular members that form the frame of most conventional weight exercise and rehabilitation machines and stands.

Figure 7:
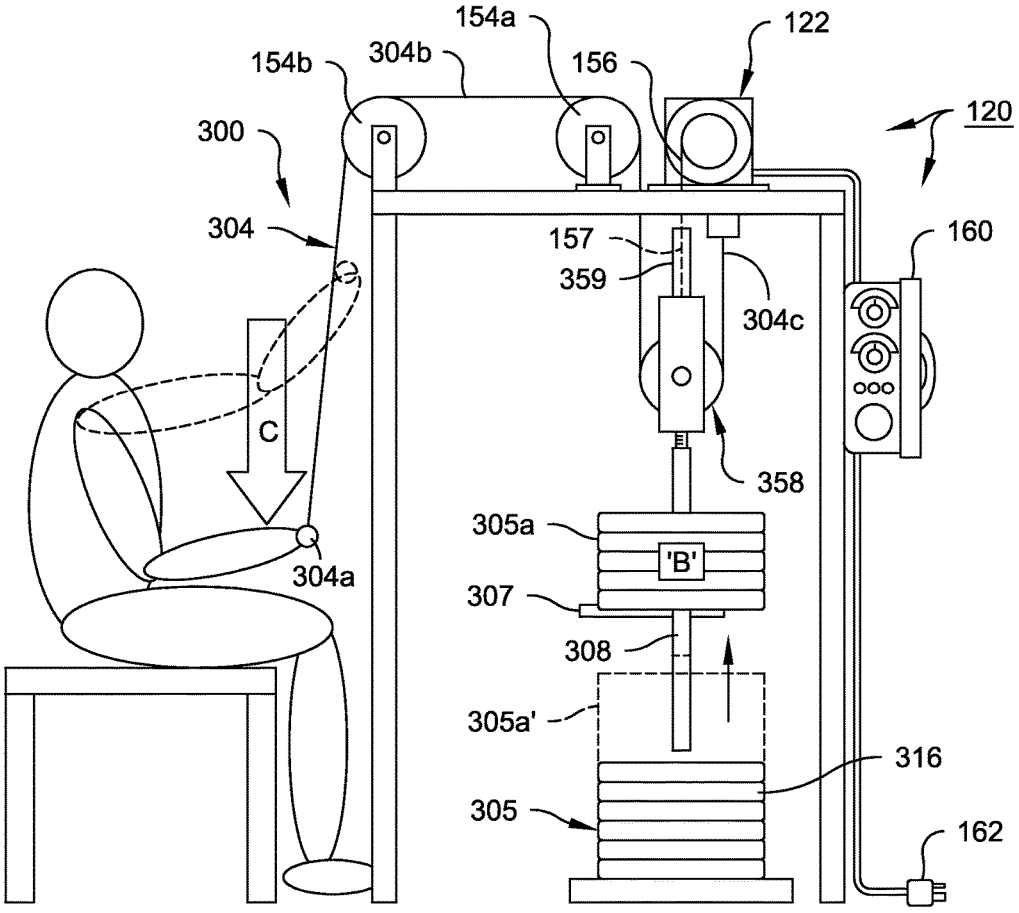
FIG. 7 illustrates diagrammatically another slightly different mounting and arrangement of the assist force delivery apparatus of FIG. 1 as it might be supplied as a kit or accessory and installed in a conventional, commercially available weight stack machine.

FIG. 7 depicts diagrammatically, another suggested installation of the same basic assist apparatus 120 with a different type of exercise machine 300 employing a stack 305 of weight plates 306, subsets of which like 305*a* may be user selected by the passage of a pin 307 through a weight bar 308 that extends vertically down through the height of the stack 305. This is a much more common form of exercise machine than the "free weight" stands previously described in FIGS. 1, 4 and 5.

The same basic components of the apparatus 120 are used including assembly 122 and control box 160 with electrical and electronic components. This time, however, the second/free end 157 of flexible assist member/cable 156 attaches to a movable pulley 358 on a connector 359. The primary load interface (PLI) 304 in this machine is a handle or bar 304*a*, connected with another cable 304*b* having an end 304*c* fixedly connected to the frame 302. The parameters of the human-machine interface 170 would be set in a similar fashion with no weight plates or just one or two weight plates 306 attached to the end of cable 156 to keep it taunt as at least an upper position limit is entered. At the starting point (subject's phantomed arm and weight stack 305*a*' in FIG. 7), there is no primary load on the PLI 304 as the stack 305/305*a*' is self-supporting. The concentric movement of the subject's arm is down (arrow C) from the upper (phantom) arm position to the lower (solid) arm position in FIG. 7. With that movement, the upper portion or subset of the weight stack 305 above pin 307 is raised from the lower position (subset stack 305*a*' in phantom) to the higher position (subset stack 305*a* in solid) while an assist force (A) is supplied by the apparatus 120. The eccentric movement is the reverse (from the arm down to the arm up position) during which movement only enough torque/assist force is generated by the apparatus 120 to keep the cable 156 taut.

Figure 11:
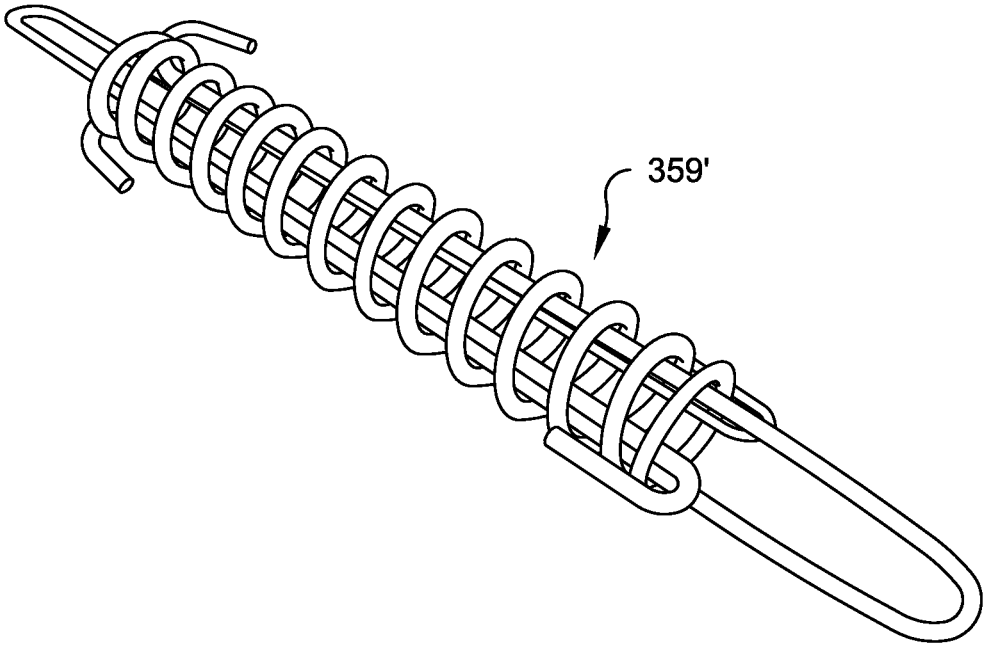
FIG. 11 depicts an in-line spring tensioner that might be used to connect a flexible assist member to the primary load interface.

If the machine 300 were not originally supplied with a movable pulley like 358, the second end 304*c* of cable 304*b* would have been originally attached to the upper end of the weight stack bar 308. Since in FIG. 7 embodiment, the primary variable load 306 is being supported by the PLI cable 304*b* on both sides of the movable pulley 358, the modification of the stand to this configuration with pulley 358 would effectively halve the load being lifted by the PLI cable 304*b*. In other words, a ten pound pull on cable 304*b* would lift twenty pounds of weight plates 306. Accordingly, the parameters of the current/torque conversion in the main digital controller/PLC 180 170 would have to be modified to reflect the different assist forces that would be required. For example, a forty pound assist force would have to be provided to generate an effective twenty pound assist at the PLI handle 304*a*. An alternative would be to supply an assist cable 156 with mounting hardware which would permit the cable 156 to be attached to the top of the weight bar 308 with the end 304*c* of the PVI cable 304*b*. For example, cable 156 could be provided with a ring at its end 157 and mounting hardware that would attach to the top of the weight bar 308 such as an S shaped hook that could be connected between the ring at the end 157 of the cable 156 and a ring provided at the top of the weight bar 308 to similarly receive an end of the PLI cable 304*b*. Yet another alternative would be to custom make a replacement for the particular hardware an exercise machine manufacture would normally supply with its machine to attach its PVI cable directly to the weight bar 308 to further connect the end 157 of the assist cable 156. An additional feature and possible alterative mode of connection might be spring tensioner 359' like that shown in FIG. 11, which could be positioned between the yoke supporting pulley 358 and the ends of the cables 304*b*, 156 to provide shock absorption capability.

Figure 8:
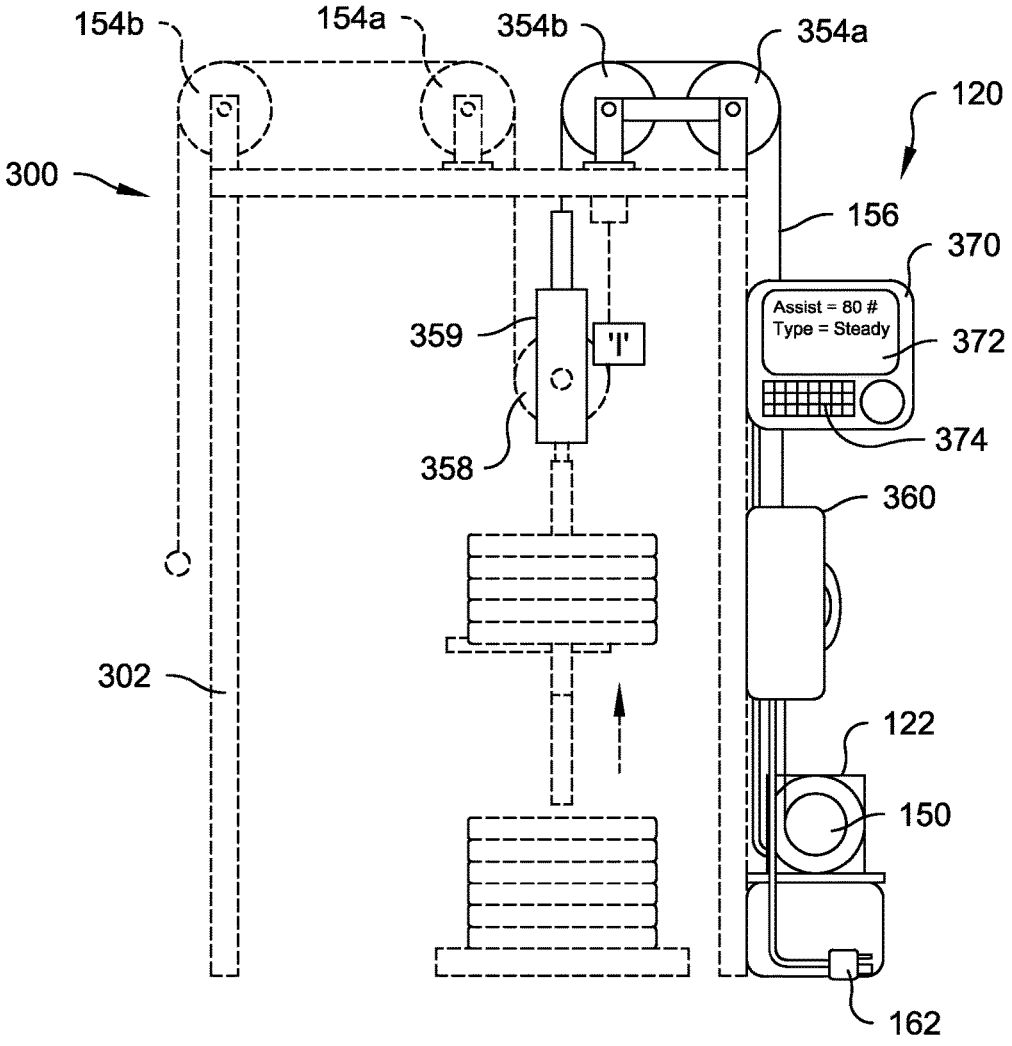
FIG. 8 illustrates diagrammatic another configuration and installation of the assist force delivery apparatus of the present invention as it might be supplied as a kit or accessory for "floor" mounting with a different human-machine interface.

FIG. 8 depicts diagrammatically another slightly modified form of the apparatus 120 in a "floor" mount where the assembly 122 is located at or near the bottom of the frame 302 and the assist force cable 156 is extended from the reel 150 over a pair of cable guides in the form of pulleys 354*a*, 354*b* at the top of the frame 302 and down to the movable pulley 358. In this embodiment, the human-machine interface is indicated at 370 and the control box without the HMI components is indicated at 360. The HMI 370 is a higher level machine with visual display 372 and keyboard 374 to provide a conventional, computer-type digital graphic user interface. HMI 370 might be, for example, an Allen Bradley 2711P-T7C4D8 operator interface, which might be used with the previously identified Allen Bradley servo motor and other Allen Bradley components such as a Kinetix™ 350 servo drive, an Allen Bradley 1606-XL 120D DC power supply and the Ethernet switch 196.

Figure 9:
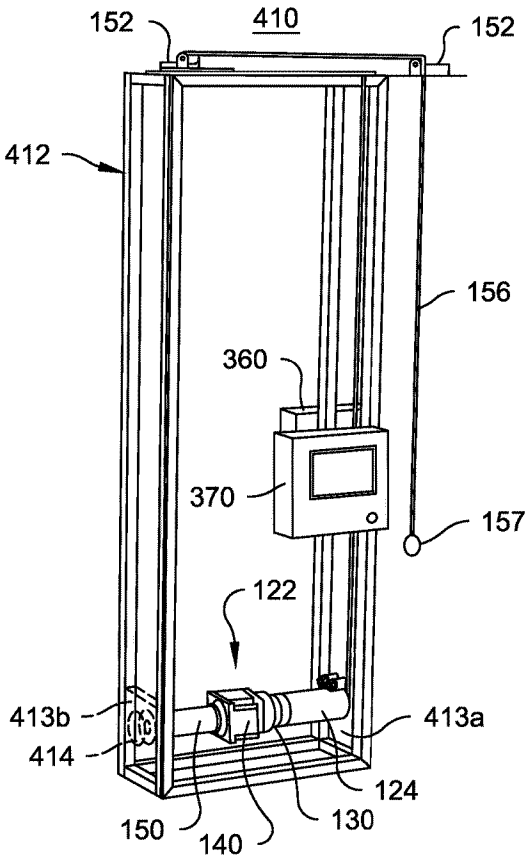
FIG. 9 depicts a motorized assist force delivery apparatus with a mounting tower.

FIG. 9 depicts another embodiment of the present invention that might be supplied in kit form for "after-market" attachment to an existing/conventional weight training or rehabilitation/therapy machine or other exercise or rehabilitation station. Assist apparatus 410 includes the previously described assist force assembly 122 mounted with a control box 360 on its own frame or "tower" 412 and provided with a digital human machine interface 370 that could be mounted to the frame 412 or the frame 102 of the stand 100 or a machine. Necessary cable guides such as rollers 152 and/or pulleys may be supplied with the kit or ordered as required. The assembly 122 can be mounted to a plate 413*a* at one (the right) end of the tower 412 though a box platform 124 of a selected length. If desired, the tower 412 could be provided with a second plate 413*b* (in phantom) at an opposing (left) end of the tower with a bearing 414 (also in phantom) to receive a distal end of the output shaft of the gearbox 140 that is selected to be sufficiently long to extend entirely through the reel 150 and into the bearing 414, in order to help support the load on the reel 150 from the cable 156 at both ends of the assist assembly 122.

Figure 10:
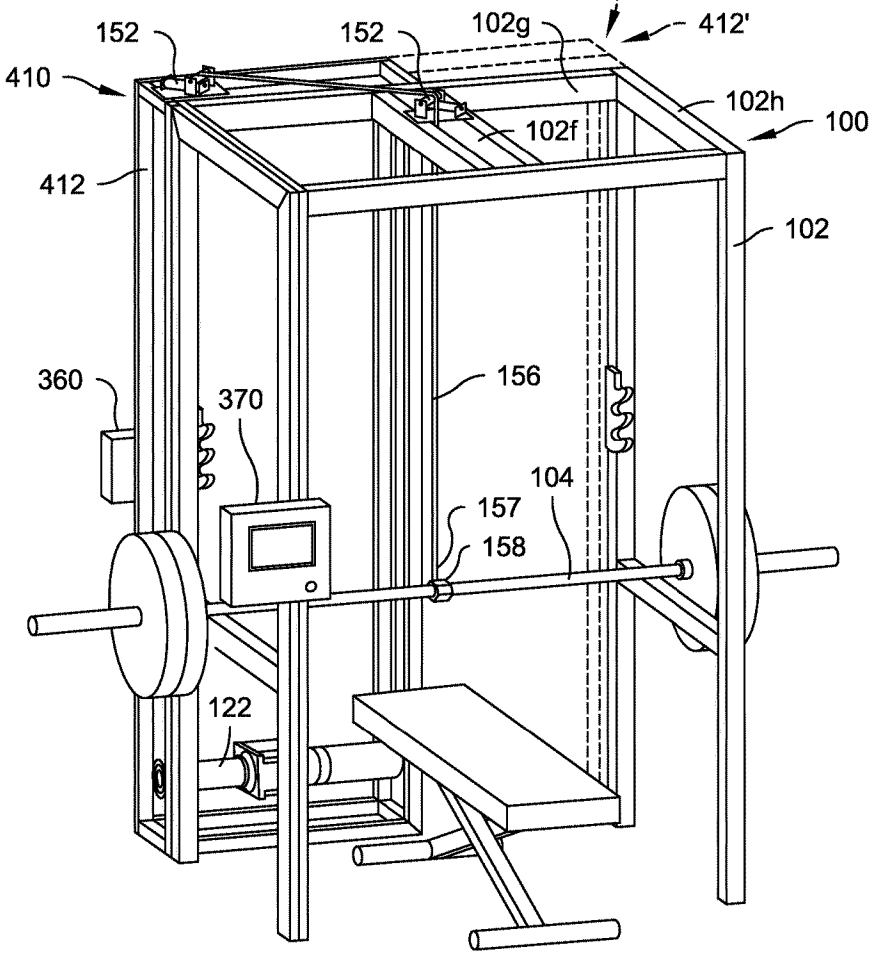
FIG. 10 depicts possible installations of the apparatus and tower of FIG. 9.

FIG. 10 shows one possible connection of the apparatus 410 of FIG. 9 on the bench press stand 100 of FIG. 1. In this installation, the top member and left vertical member of frame 412 are against similar members of the stand frame 102 and can be secured thereto along those frame members. Alternatively, the tower of the apparatus can be positioned at the right rear end of the stand frame 102, where it is indicated in phantom at 412' and 410', respectively. In that arrangement, the reel 150 and assist cable 156 would be more laterally aligned with the center of the stand 100 and the weight bar 104. It will be appreciated that the high tower 412 could be replaced with a smaller cage, preferably still having the mounting end plates 413*a*, 413*b* and bearing 414 (FIG. 9) and be mounted at or near the bottom of the frame 102 or across the top of the frame 102 using the central upper frame member(s) 102*f* for support with the rear and side upper frame members 102*g*, 102*h*. Other arrangements will occur to those of ordinary skill in the art to adapt the apparatus kit to different machines and frames.

It will be appreciated that the provision of a more powerful main digital controller 180 with an interactive digital HMI 370 like the Allen Bradley 2711P-T7C4D8 and greater memory in any of the aforesaid or any of subsequently described machines and/or stands would allow the apparatus 120 to store a great deal more information and permit greater flexibility in exercises. These changes could enable the provision of a User Performance Program that analyzes a user's past data, rate of progress, bio-metric feedback and pre-determined goals to produce a forward exercise plan, or dynamically alter the active exercise plan, that will optimize that user's progress towards those goals. It could include the provision of User Specific Data, a body of data collected and electronically stored on behalf of an exercise subject that can include all related past exercise data and or user input data like height, weight and age, goals, etc. It could also include Dynamic Load/Assist Variation parameter(s) to vary the assistive load during the exercise repetition by position, time, both or in real-time response to a subject's actions, motion or pre-programmed profiles and/or event triggers. It will be appreciated that even using a table look-up system as has been suggested, it will be possible to easily change assist forces generated for separate movements in a rep set in a step fashion and, with enough memory, it would be possible to create assist profiles that vary within a single movement. It could also include the provision of custom Load Profile as to how the PVL will be made to vary by the provision of Dynamic Load/Assist Variation with either changes in position of the PLI, or time during the repetition, or in response to real-time user responses or system sensors. It could include the provision of User Specific Parameters, predetermined control values for PVI and/or PVL, Assistive Load values, or changes to these values over position or time, that can be set or varied for each exercise subject. It could also include the provision of User Specific Profiles that would be a combination of static user data in any point in time which, when combined with historical user specific data, can be manipulated, analyzed and presented in a way that can characterize user status and progress and may be used to plan future exercise regimens. Dynamic Load/Assist Variation refers to variations in the assistive load during the exercise repetition, varying by position, time, both or in real-time response to a subject's actions, motion or pre-programmed profiles and/or event triggers. It could include the provision of User Specific Set Points refers to predetermined exercise parameters that can be set or varied for each exercise subject. These include position range limits, PLI velocity or acceleration, assistive force etc. and includes points that might be static or made to vary. Other aspects of prior art assistive and resistive systems may also be incorporated or adapted for incorporation into the apparatus.

It should be further appreciated that the initially identified "main digital controller" was a single, commercially available component, a programmable logic controller/PLC. A more powerful main digital controller may also be a single device or a number of individual devices with the control functions of the apparatus 120 divided among a number of individual devices, each with a processors and memory and programmed to perform a discrete control function of the apparatus 120 or a number of individual devices networked together to collectively provide the control functions of the apparatus 120. Such sets of individual devices will be understood to constitute the "main digital controller".

Furthermore, it has been previously mentioned that during limit set-up and the eccentric movements of exercises, the servo motor must be still be operated to allow movement (feed or take-up) of the flexible assist member. During such movements, the servo motor is controlled to provide a minor force sufficient to just keep the flexible assist member taut, i.e. to prevent slack or sagging. This minor force, which might be considered a drag or static force, is to be less than the least selectable non-zero assist force, i.e. less than ten pounds at least for exercise machines, is preferably less than two pounds, and more preferably only a pound or less. The main digital controller 180 would have the drag/static force or its equivalent servo motor current control value or command pre-stored in memory. Furthermore, if desired, a zero assist force selection could be provided for users who desire to perform an exercise on the equipment without an assist force. Again, even with a "zero" assist force, same static/drag force would be desirable to take up slack and prevent overrun of the reel while feeding out cable.

Desired assist forces are expected to be in a range of ten to two hundred pounds for more for exercise machines. However, as much as six hundred pounds of assist have been contemplated. Many but not all rehabilitation/therapy machines/stands would be expected to use smaller PVL's and require even lower assist forces. Accordingly, for rehabilitation/therapy stations (stands and machines), the flexible assist member may be lighter and/or the reel diameter smaller but still permitting the use of a drag/static force less than the smallest non-zero assist force that can be selected with the apparatus, and perhaps as little as a few ounces. Assist assemblies may be configured to provide selectable assist forces over portions or subsets of those ranges, to reduce expense and cost. For example, less than two pound-feet of torque is necessary to provide ten pounds of assist force from a four inch diameter reel ($10\times\frac{1}{6}=10/6$), and only two and one-half pound-feet would be required with a six inch diameter reel ($10\times\frac{1}{4}=2.5$). The previously identified assembly 120 is configured and capable of providing assist forces over the entire expected range and is further capable of generating and maintaining a constant selected torque level during reel rotation.

Although the assist apparatus described thus far have been configured to provide assist force in only a concentric portion of an exercise, it would be possible to use a modified assist apparatus to provide assist during both concentric and eccentric portions of an exercise to simplify the basic machine or stand. So, for example, the instead of a bar 104 receiving one or more removable weight plates 106, the bar might be permanently loaded with a maximum usable weight, for example, three or four hundred pounds and the remainder of the apparatus modified to provide eccentric as well as concentric assist, but in different amounts. The main digital controller would be configured to provide a selectable eccentric assist force from the assembly 120 but, preferably, one that must be less than the selected concentric assist force and greater than the static force. The human-machine interface 170 might be supplied with another dial or manual data entry device to identify an assist force for the eccentric portion of the exercise different and independent from that entered via the dial 178. The main digital controller would be configured by programming or hardware to control the assist assembly 122 to provide the different assist forces during the different movement portions of an exercise. The drag force may be instated before and after the completion of the identified number of reps and the concentric assist force may be maintained during the last eccentric movement as previously mentioned. With the provision of a more powerful main digital controller, a lot more flexibility and variability might be provided in the operation of the assist assembly as also previously mentioned.

Figure 12:
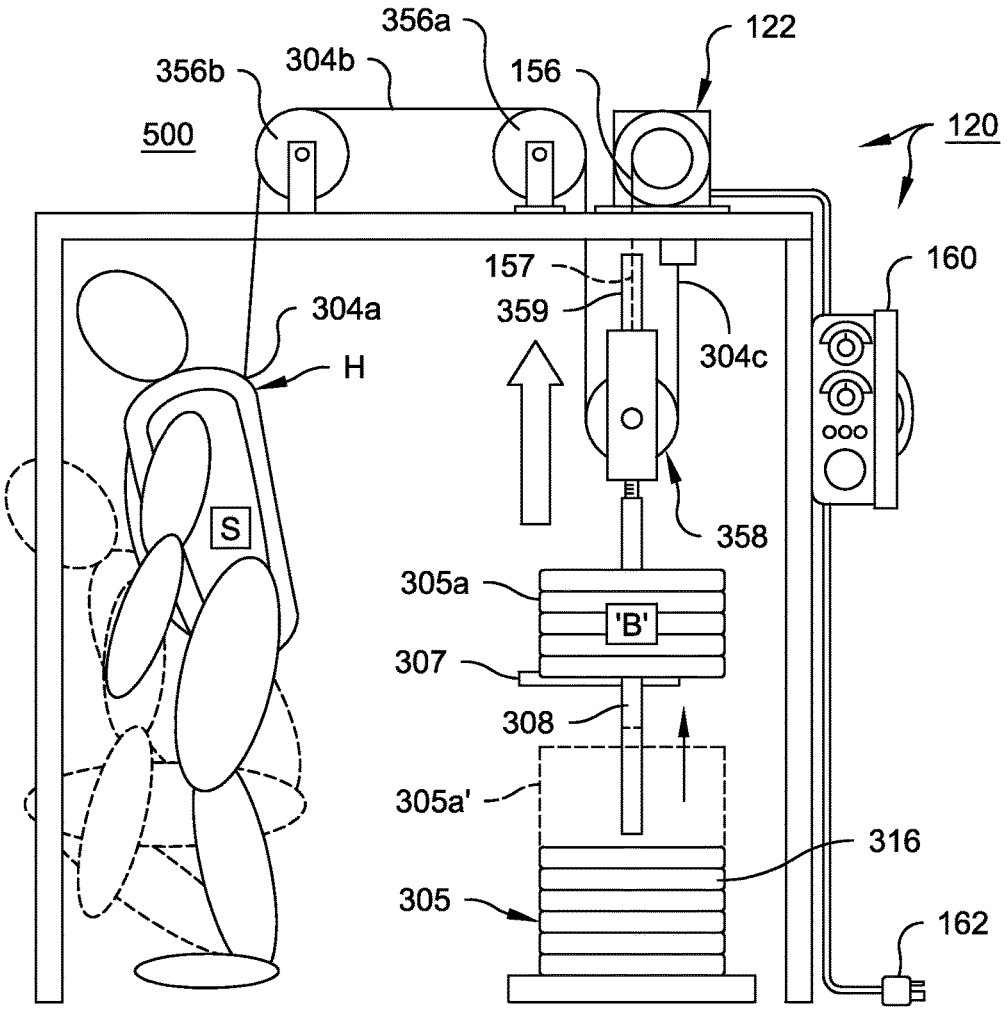
FIG. 12 depicts a modification of FIG. 7 machine for rehabilitation use.

There is already evidence that at least some paraplegics might be able to recover the use of their leg muscles if properly stimulated and allowed to redevelop gradually. This could be accomplished by gradually increasing the user's physical strength in small increments over time. Referring to FIG. 12, the FIG. 7 apparatus 120 could be modified for such a rehabilitation/therapy role by connecting the free end of weight cable 304*b* to a harness H on a human rehabilitation/therapy subject S to fully or at least partially support the weight of the subject while the subject works rebuilding neuro-muscular connectors in to be able to support him or herself while standing, walking, stooping/squatting/sitting/etc. and rising. The selectable stack 305 of weight plates 316 provides a primary weight offsetting a subject's own weight to a selected extent. A rehabilitation weight machine 500 is provided or retrofitted with at least an assist apparatus 120 including assist assembly 122, control box 160 and other components as previously described. The assist assembly 122 operates on a variable primary load (VPL) in the form of a selectable stack 305 of weight plates 316. The VPL may be the entire weight of the subject S so the harnessed subject is essentially hanging in the harness H or something less than the harnessed subject's entire weight so that the subject must support that amount of his own weight in order to stand or move. Weight cable 304*b* has a first end 304*c* fixedly connected to the stand frame 502. Cable 304*b* then wraps around movable stack pulley 358 and then on around a pair of fixedly mounted idler pulleys 356*a*, 356*b* where the free end 304*a* of the cable 304*b* connects with the harness H, which, with cable 304*b*, constitutes the primary load interface (PLI) of apparatus 500. The second/free end 157 of flexible assist member cable 156 again attaches to movable stack pulley 358 on connector 359 to supply an assist force to the selected portion 305*a*' of the entire weight stack 305 and thereby reduce the support provided to the subject S by the selected portion 305*a*'. One movement exercise repetition would be an eccentric movement from standing to squatting and a concentric movement from squatting to standing, or reversing that sequence. In addition to movement exercise, the machine 500 could also be configured for static exercise with the assist apparatus 120 cycling through consecutive periods of greater and lesser assist force or assist and non-assist force based upon time with little or no movement of the weight stack 305*a*' or the subject S so as to require the subject to support his or her weight to a greater or lesser extent while standing or in any other desired upright position. Again, the operating parameters would be entered into a main digital controller (like 180) through a Human-Machine Interface (like 170).

Although it has been indicated earlier that the assist provided in a rehabilitation/therapy machine or stand might be less than the levels suggested for weight exercise, it should be appreciated that to be useful to a wide range of subjects with a wide range of degrees of recovery, it would be desirably for the device 500 to be able to provide a wide range of assist forces, for example, from one to one hundred pounds or more.

Again, because of the presence of the movable weight stack pulley 358, the lift provided to the subject by the stack 305*a*' is actually one-half of the selected weight (number of weight plates 316) of the stack 305*a*'. The assist apparatus 122 must supply twice as much force to the movable stack pulley 358 as the desired amount of assist to be provided to the subject. To provide one hundred pounds of assist to a subject in the FIG. 12, machine 500 would require the generation of two hundred pounds of force by the assembly 122. Accordingly, the FIG. 12 apparatus might not be a desirable configuration to provide a wide range of assist force. Moreover, fixed idler pulley 356*b* provides direct support only with the connected end 304*a* of the flexible support member directly under that pulley.

Figure 13:
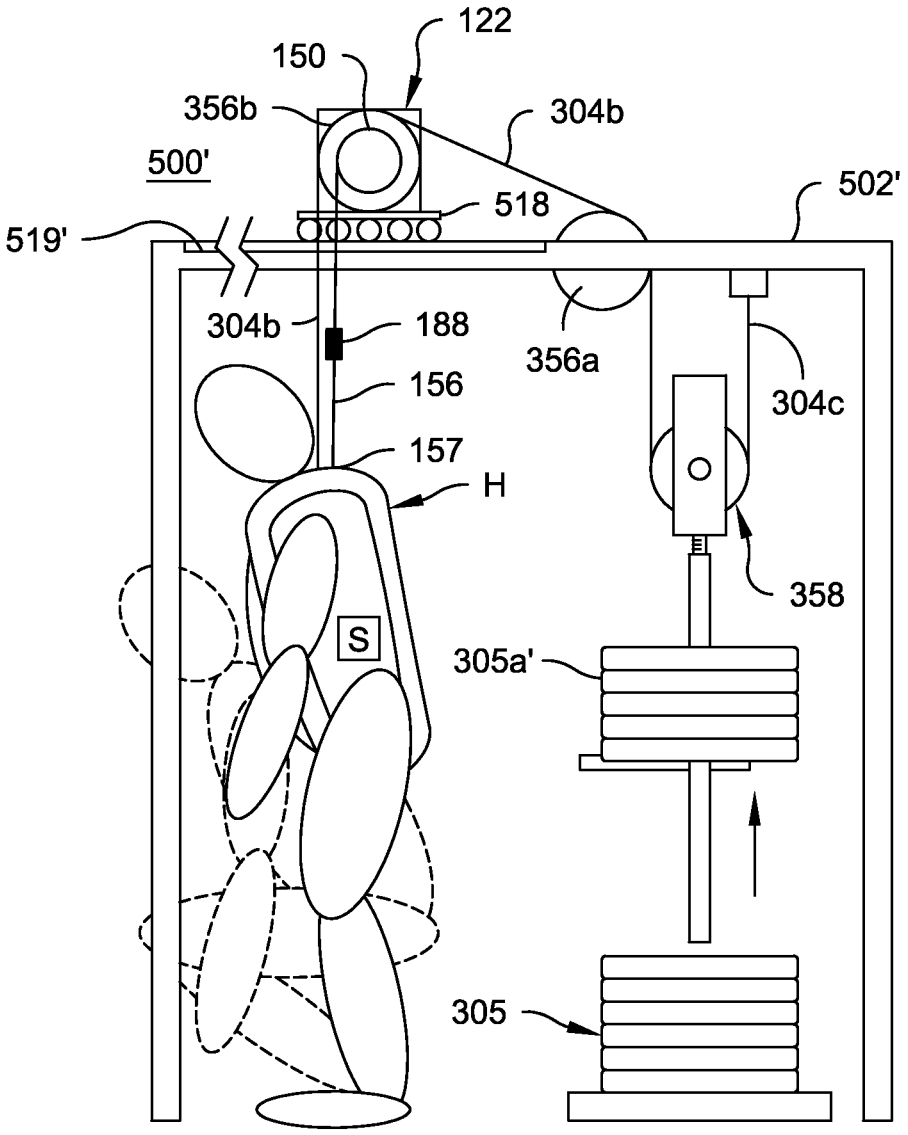
FIG. 13 depicts a modification of the machine of FIG. 12.

FIG. 13 illustrates a modified arrangement of the rehabilitation machine configuration indicated generally at 500'. Frame 502' of machine 500' is taller than human subjects expected to use the machine. The frame 502' should be taller than six feet and preferably between seven and eight feet. Instead of being connected with the weight stack 305 as in 500, the free end 157 of the flexible assist member cable 156 is connected directly with the harness H to apply the assist force directly to the harness H end of the primary load interface and subject S. This halves the force generation required of the FIG. 12 embodiment assist assembly 122 as the assist force output by the assembly 122 in FIG. 13 is not being applied to the movable stack pulley 358. This permits a smaller motor 130 and gearbox 140 to be used compared to the requirement of the FIG. 12 embodiment to provide equal amounts of assist force to the subject. This embodiment 500' would be able to provide double the range of assist forces than would an identical apparatus in the FIG. 12 configuration.

In this embodiment 500', the assist assembly 122 also can be mounted on a carriage 518 permitting some lateral movement (left-right in FIG. 13) of the assembly 122 along a glide track indicated generally at 519' provided at or near the top of the frame. The carriage 518 provides some mobility to the harnessed subject S. There is no need in the FIG. 13 embodiment as there is in the FIG. 12 embodiment 500 to maintain the assist assembly 122 over the weight stack 305 as the apparatus 122 is not connected directly with the stack 305. Also, the weight cable 304*b* might be passed over the output shaft on a free turning pulley 356*b* mounted on the output shaft supporting the reel 150 so that the cables 304*b* and 156 between the assembly 122 and subject S apply parallel or essentially parallel forces to the harness H.

Providing the assist assembly 122 on a carriage 518 further permits subjects S to practice walking developing sufficient strength through actions that will involve additional muscle groups. The carriage 518 may move passively, dragged by the subject, or it could also be motorized. When motorized, its motion could be initiated in either of two possible directions in response to sensors which would identify the direction and angle by which the flexible assist cable 156 has been moved beyond a stationary position otherwise indicated by a perfectly vertical output cable orientation. If the cable's attitude would exceed a predetermined amount, for example, five degrees (5°), simple mechanical or photo sensors can output the direction of the attitude as well as state of the attitude (more or less than the predetermined degree amount) to a processor on the carriage 518, which would activate a carriage motor to move the carriage in the direction of the subject S until the cable angle was restored within acceptable angular limits with respect to perfect vertical. Carriage design and control could be easily adapted from that of remote control toy vehicles.

Figure 14:
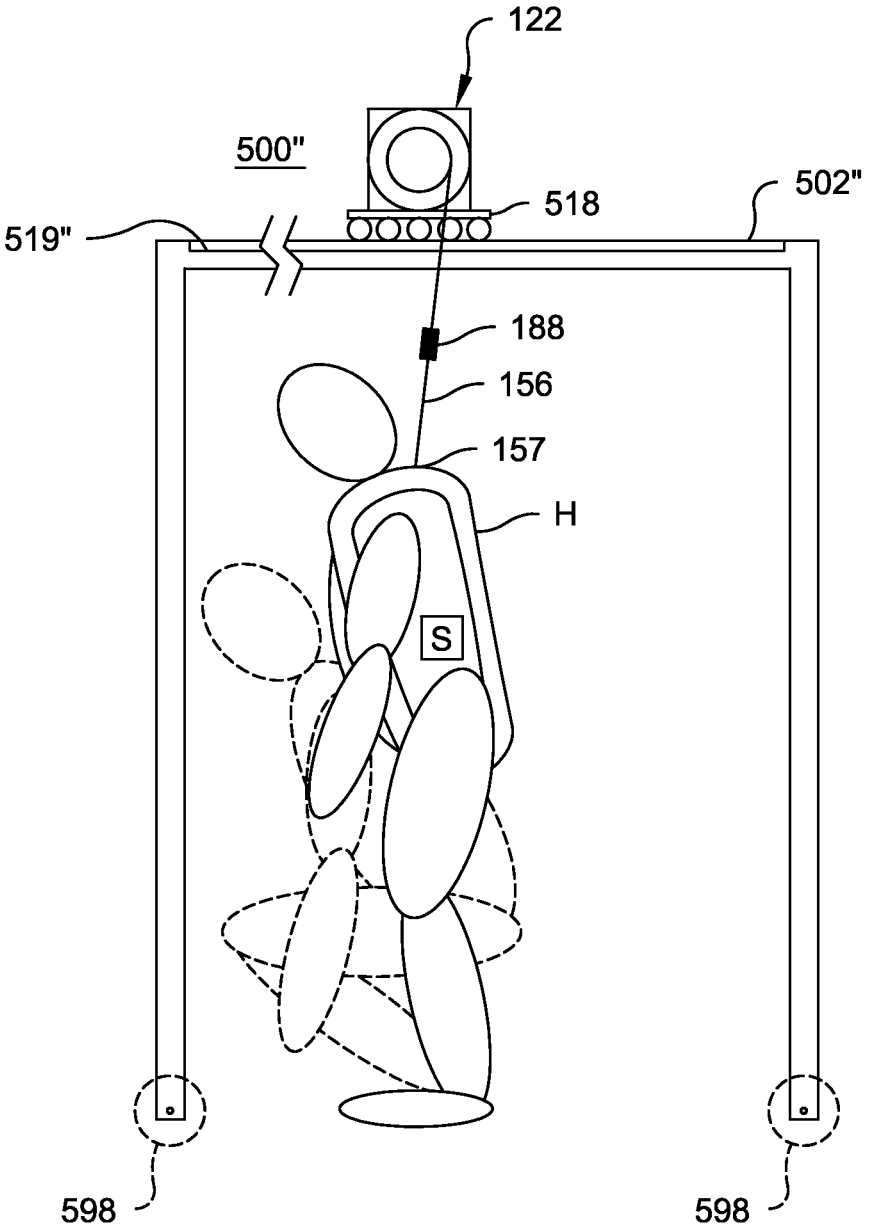
FIG. 14 depicts a further modification of the machines of FIGS. 12 and 13.

FIG. 14 depicts an even simpler rehabilitation embodiment indicated generally at 500", employing just a frame 502" as a stand supporting the assist assembly 122. As in the 500' embodiment, assist force is applied directly to the subject S through the harness H but the weight stack 305 of the 500' embodiment is eliminated. The subject S is the primary variable load (variable to the extent the subject supports himself) and the harness H is the primary load interface with which the apparatus 122 is operably and, in this case, directly connected. In this embodiment 500", the assembly 122 must supply the entire force required by the subject S, up to the full weight of the harnessed subject S. Other parts of the apparatus previously described (e.g main digital controller, HMI, etc.) have been omitted to simplify the figure but would be provided for the apparatus.

Again, the assembly 122 might be supported on a movable carriage 518 on a glide track 519". As the assist assembly 122 would not be connected to any stationary weight stack, the length of the frame 502" and the glide track 519" can be made longer than the lengths of the 500'/519' embodiment and that of the 500 embodiment. However, it will be appreciated that with the removal of the weight stack 305 from the 500" embodiment, the embodiment 500" will be much lighter than the 500 or 500' embodiment, even with a heavier motor and transmission and sufficiently light that it would be possible to instead support the frame 502 on a plurality of its own rolling members, e.g. wheels and/or casters indicated in phantom at 598 to make the frame 502" and "stand" 500" mobile. In this version 500", the assembly 122 would be fixed to the frame 502". This might be particularly useful for a subject whose rehabilitation would be helped by walking distances greater than the length of the frame 502' but who still also need considerable assistance to support his or her own weight. The plurality of rolling members option might also be desirable where there is no desire to take up valuable floor space with a long, stationary frame 519".

The stand 500" may be used as follows. A subject S might be brought to the stand 500" in a wheelchair (not depicted), already wearing a suitable harness H. During this initialization period, the main digital controller would provide only a static or other comparably modest drag force on the flexible assist cable 156 so the cable can easily be manipulated by an attendant to attach the cable end 157 to the harness H. This static/drag force might normally be applied as long as the apparatus 120 was powered but the assist not in use. An assist weight and a lower position limit, for example, equal to that of the subject seated under the assist assembly 122, would be entered through the human-machine interface (170). The attendant would then command the assembly 122 to generate and apply the selected assist force through the cable 156 in an amount equal to the harnessed subject's weight minus some selected amount, say ten pounds as an example. The subject will then only need to supply the difference (ten pounds) with his own 'effort' to stand up from the wheelchair. Alternatively, an assist force equal or essentially equal to the harnessed subject's weight may be provided to the subject by the apparatus 120, to elevate the subject to a standing position with no effort or only the smallest amount of effort from the subject. The apparatus 120 could be programmed to operate the assembly 122, after the subject is elevated, for static exercise with the assembly 122 cycling through generation of a full weight assist force and a lesser assist force, or some variable set of assist forces so as to require the subject to support his weight to a greater or lesser extent while standing, for example, or during movement exercises. In the other embodiments 500, 500', the weight stack 305 would have to be initially addressed to provide some selected weight less than that of the harnessed subject before the assist force is generated to elevate or assist the subject to rise from the chair.

Assist force resolutions as fine as one-half pound might be necessary to permit re-awakening of a subject's neuromuscular connections ever so gradually, but then allow slowly increasing the level of effort required of the subject as re-awakening progresses (which is accomplished by decreasing the level of machine provided assist). As the subject progresses and become stronger, the apparatus 120 could then be programmed to also allow the subject to perform multiple repetition exercises and through a full range of motion, or any range of motion desired, and according to pre-established concentric and eccentric assist values or with sufficiently powerful main digital controller assist force tables or curves.

Various optional interfaces to the apparatus 120 can also be designed that will also permit an attendant to regulate an assist force from the assembly 122 in real time as opposed to simply a pre-programmed assist value or set of values or variable assist profiles. The human-machine interface 170 and main digital controller 180 might be modified from the previously described embodiments to perform these steps. For example, a manually operated, variable input device such as another rotary switch and dial, a two way switch with toggle or joy stick actuator, a pair of up/down buttons, or some other manually operated variable input device, might be provided in a portable, hand controller that an attendant can carry, to supplement the operation of the frame mounted HMI device 170. This would allow an attendant to provide real-time, dynamic adjustment of the assist force during concentric and/or eccentric loading in response to his/her observations of the subject's own movements, progress or even distress.

It further will be appreciated that the performance requirements imposed on the assist assembly 122 and its components 130, 140 and 150 will vary with the weight training/rehabilitation exercise machine/stand configuration and the intended use machine/stand in terms of the amount of assist force to be provided. So, for example, if the primary support is to be provided by a weight stack like that in FIG. 12 or 13, and only modest assist force is to be provided by the assist assembly 122, the assembly 122 of machine 500' can be much smaller than the assembly 122 in the 500" stand, which is required to provide full or essentially full weight support to a subject, and even the FIG. 12 machine 500, depending on the range of assist to be provided. Smaller motors will require less power, will be lighter (hence easier to move laterally in the case of embodiment 500') and also cost less, an especially significant advantage if servo-motors are employed. Also, smaller weight change increments will be more reliably achieved. There is, therefore, a trade-off to be made between the simplicity of the stand 500" and potentially lesser motor assist requirements of the machine 500' and even 500.

If a single motor sized to provide a maximum of only ten pounds of lift is asked to reduce its assist from 10 to 9.5 pounds, the ½ pound difference represents 5% of its total available output. If a particular system design is only capable of delivering a requested load to say within +/−1% of the desired weight, the error in the smaller motor will be measurable in ounces. In this example the motor might actually provide 4-6% of its total available output or, an actual force change lying between 6.4 and 9.6 ounces, a band spanning 3.2 ounces. In contrast a motor capable of and providing 300 total pounds of assist, being then asked to reduce it to 295.5 pounds, is being commanded to change its delivered power by 0.16%, an increment of resolution 30 times greater than the smaller motor, and completely beyond its capabilities. In a system designed with the 1% tolerance band means that the 300 pound assist bigger motor is always operating with a +/−3 pounds tolerance. This strategy, when applied to the smallest motor necessary within a system, will produce even better resolution and with much less energy loss than would otherwise be incurred in a system forced to stay within a narrower tolerance band than the motor is capable of on its own.

This is important as it should be appreciated that internal system losses arising from cable, bearing and pulley friction, etc. are ever present both in static and dynamic forms, and may require more force to overcome than the desired level of incremental change of the subject's assist force. Some minimum amount of power will always be required by the motor 130 or other actuator of the assembly 122 to assure adequate response time to real-time system demands; that is, to overcome system drag and keep the motor-gearbox in a 'ready' state. This might be as little as 1/50th hp. Any additional power above this would be available to fulfill the assist requirements. In a machine 500 or 500', where the primary offset weight is provided by selectable weight plates 516 there may be as little as ten total pounds of assist force required of the motor. However, in these machines, there are two, nearly equivalent masses (weight stack and subject) jointly connected that are being accelerated and moved simultaneously. Their combined inertia affects the sizing of motors and any gearboxes.

Specific requirements for response time and resolution to small assist force increments may require or make desirable, the provision of a linear force transducer 188 (such as Futek # FSH00086) in line with the flexible assist member 156. Output from the transducer 188 is a signal indicating a true "net-effect" of assist force being provided (i.e. "net assist force") to the harness H and subject S, which, at any moment in time, will combine torque from the gearbox output shaft with said internal system losses into the single momentary force truly being applied to the subject S. The output of such transducer would be used in a feedback circuit with the main digital controller 180, which can be programmed to automatically make or allow an attendant to enter, finite motor torque adjustments to maintain the desired "true" level of assist being provided.

Figure 15:
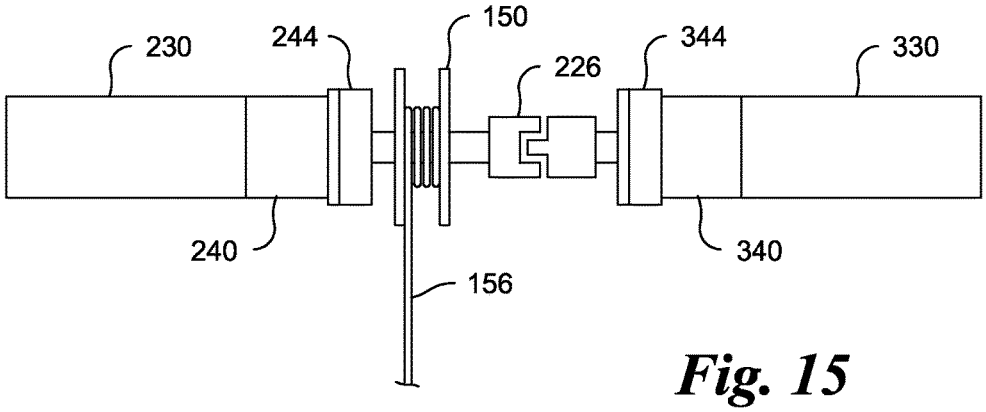
FIG. 15 depicts a first exemplary assist assembly embodiment with multiple motors.

Another way to address this tolerance problem is through the use of multiple motors in an assist assembly. The advantages of a multi-motor system will vary with the application. If two motors are used to provide the primary load (i.e.; like embodiment 500" with no supplementary weight stack), then two, approximately half-sized motors can replace the one bigger motor 130. FIG. 15 depicts two equally sized motors, 230 and 330 with gear boxes 240, 340 and electro-magnetic clutches 244, 344 co-axially connected together through mechanical coupler 226 to simultaneously drive reel 150 fixed on the output shaft from the first motor 330. Under normal operation, clutch 244 is engaged but clutch 344 is not, so motor 230 is the only power source for reel 150. When commanded by the main digital controller 180, clutch 344 engages so that motor 330 can also provide a force additive that produced by motor 230. If motors 230 and 330 are equal in size, then the dual clutch arrangement 244, 344, with or without an additional mechanical connector 266 between the two allows either motor 230, 330 to be assigned to the role of "primary" and the other as "auxiliary". Such an arrangement, would have the advantage of swapping the roles of the motors based say, on duty cycle, so that wear and tear on the two motors is shared equally without affecting the system's operation. A variety of electromagnetic clutches suitable to this application are commercially available. For example, the Ogura Industrial Corp. "CT" series family of EM clutches can transmit torque from 22 ft-lbs (CT-20) up to 150 ft-lbs (CT-150). As noted earlier, a 4" diameter reel (2" radius) would thus be able to provide cable load forces up to six times the rated capacity of these clutches. Other factors being equal, the substitution and operation of two smaller motors of equal size for one larger motor double their size should reduce their collective drift and halve the assist force resolution the two smaller motors can collectively supply.

Figure 16:
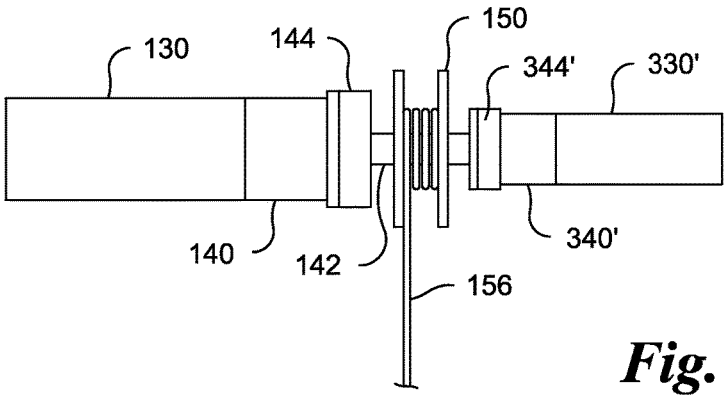
FIG. 16 depicts a second exemplary assist assembly embodiment with multiple motors.

Another multi-motor option to use in some of the earlier described machines and stands would be to provide motors of different sizes to perform different task like main assist and finer assist adjustment. FIG. 16 depicts two motors 130, 330' of unequal size coupled coaxially with the same shaft 330 through gear boxes 140, 340' supporting a reel 150. A first, larger motor 130 can be assigned the task of providing the assist force or the bulk of the assist force, for example, selectable in ten or twenty pound increments, while the second, smaller motor 330' is assigned the task of fine assist force provision and adjustment including fine assist force resolution (fractions of ten or twenty pounds) and reaction to any drift of the first motor 130 and system losses. For the reasons previously described, this would allow finer adjustment of incremental weight differentials while also being able to provide relatively high assist forces on demand. Clutches 144 and 344' would be optional.

Yet another option (not depicted) would be to combine the two, equal size motors 220, 330 to split the heavy assist requirements with the smaller motor 330' to provide small assist changes and response to motor drift and system losses.

Figure 17:
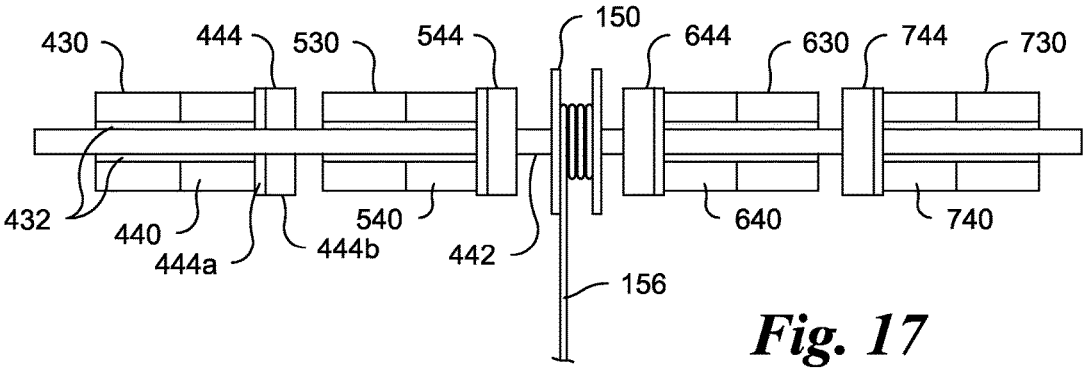
FIG. 17 depicts a third exemplary assist assembly embodiment with multiple motors.

There are multiple ways of interconnecting multiple motors when even more than two motors are to be combined. Purpose (i.e. custom) built motors can be designed with hollow center output shafts and coaxial gear boxes. Referring to FIG. 17, multiples of these motor/gear box combinations, for example, 430/440, 530/540, 630/640 and 730/740 can then be arrayed back to back along a common shaft 442, which supports a fixedly connected, assist assembly reel 150. Each motor 430, 530, 630, 730, is individually, selectively connected to the common shaft 442 through preferably electromechanical clutches 444, 544, 644 and 744. Motor 430, for example, with its gear box 440 has a hollow center drive shaft 432 that receives the common shaft 442. A first part 444*a* of clutch 444 is fixed to an end of the hollow drive shaft 432 and a second part 444*b* is fixed on the common shaft 442 passing through the hollow drive shaft 432, the motor 430 and gearbox 440. The other motors 530, 630 and 730 are all selectively mechanically and operatively connected with the common shaft 442 in the same manner through clutches 544, 644 and 744, respectively. It is noted that when the clutches are disengaged, clutch part 444*b* and similar parts (collectively x44*b*) of the other clutches 544, 644 and 744 remain fixedly connected to the common shaft 442 and increase the static and rotating inertia of the shaft 442 and reel 150. If a single clutch is then engaged to couple a single motor to shaft 442, the mass of all four clutch halves (x44*b*) will be rotated. This then could compromise finite load differential adjustments and so, once again, could necessitate or make desirable the provision of an assist force transducer 188 on member 156. Ogura's PC family of particle electro-magnetic clutches, for example, can handle output torque requirements from 9 ft-lbs to 144 ft-lbs. Some or all of these motor/gearbox combinations might be of the so-called 'pancake' variety available commercially from sources such as MACCON-GmbH. With this configuration of four smaller, equal size motors, the assist force resolution provided by each motor should be approximately four times finer than that provided in the 500" embodiment of FIG. 13, with one large motor 130 providing all assist, and may further partially cancel out drift among all the motors.

It can be appreciated then that a properly sized array of motors can help refine the control of torque and hence cable assist force being provided. It should be further appreciated that still other arrangements of multiple motors can be provided although not presented here. Again, it should be further appreciated that any of these multi-motor combinations of FIGS. 15-17 could be substituted for the single motors disclosed in the embodiments of any of the prior figures.

So far, only servo-style motors have been mentioned. They are desirable owing to their built-in positional and torque management capabilities and because commercially available, industrial servo systems regularly enjoy response times in the 5 to 10 ms range. They can evaluate, update and modify their torque in real time up to 200 times per second. This ensures a smooth rate of operation where alterations in applied torque occur so rapidly as to be transparent to users. Other applications may arise where longer response intervals can be tolerated and can be satisfied with more conventional A/C motor-gearbox combinations, albeit managed differently than with the 'bang-bang' circuits previously employed. Use of non-servo, AC induction motors is also part of the invention. The intelligence built into the servo motor would be replaced by external sensor feedback control.

Figure 18:
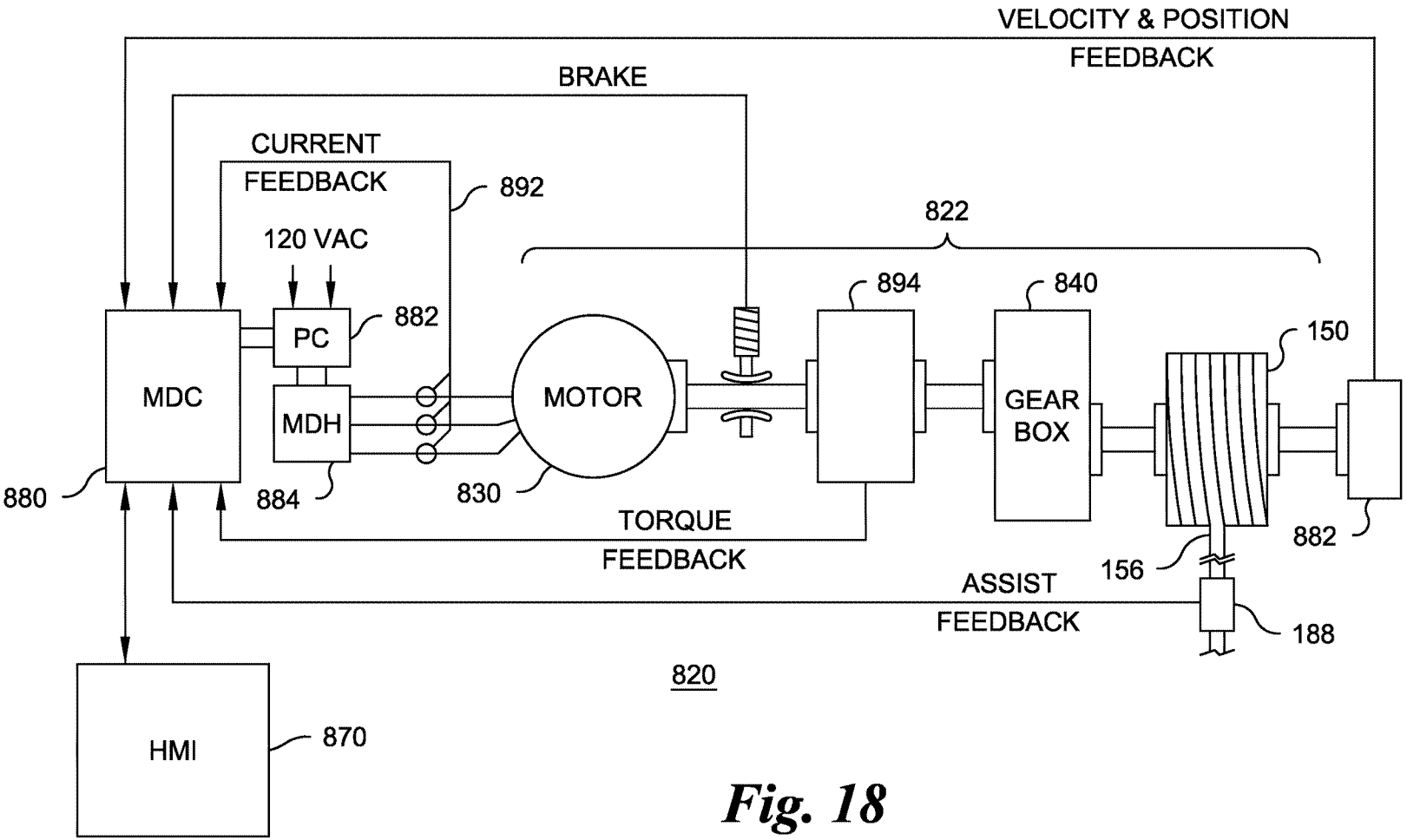
FIG. 18 depicts schematically an exemplary motorized assist assembly embodiment without a servo motor.

FIG. 18 is a schematic diagram of an assist apparatus 820 with assist assembly 822 incorporating a conventional AC induction motor 830, for example, a Marathon #Y521. The output of motor 830 is passed through a gearbox or other transmission 840 and controls the rotation of a reel 150 wound with a flexible assist member/cable 156 A main digital controller 880 (such as Allen Bradley #20AB4P2A0AYNANC0) receives current feedback from current sensors 892 (such as NK Technologies part #ATS1-010-NCAC-24U-FL) and motor output torque feedback from an appropriate sensor 894 (such as an Omega Engineering part #TQ513-100). Velocity and position feedback for the reel 150 is provided by an appropriate sensor 882 (an encoder such as Dynapar # HA725-10000-0240). A load cell 188 could be used to provide direct assist force feedback from the cable 156. A Human Machine Interface 870, preferably with display and otherwise appropriately configured for the apparatus, permits manual entry of operating parameters (and other data) into the main digital controller.

In particular, a larger AC induction motor 830 of FIG. 18 might be combined with a smaller DC servo motor 130 in a configuration like that of FIG. 16 with the larger motor 830 controlled or controllable to provide most of the assist force with relatively "slow" changes (e.g. between concentric and eccentric movements), if any, supplemented by the much faster servo motor 130, adjusting for any drift of the larger motor as well as quicker, dynamic assistance variations to the net delivered assist force.

Figure 19:
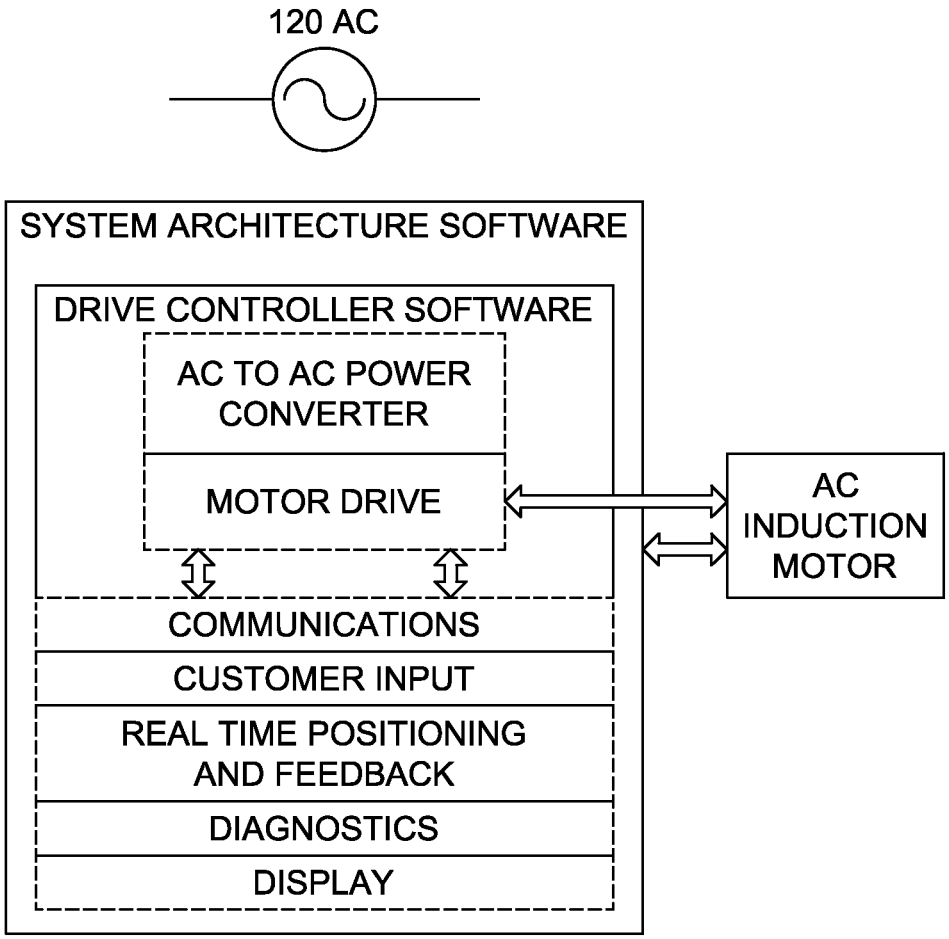
FIG. 19 is a block diagram of software system architecture for the embodiment of FIG. 18.

FIG. 19 depicts in block diagram form, one possible software architecture design for main digital controller 880. A power converter ("PC") 882 and motor drive hardware ("MDH") 884 (FIG. 18) are controlled by "Drive Controller Software" of the main digital controller 880. The other blocks all refer to the usual suite of inter-related, commercially available communications hardware, previously discussed. The HMI 870 combined with motor control 880 preferably using Ethernet communications to accept manual inputs along with real-time positioning and feedback measures.

The Drive Controller Software would incorporate a Proportional-Integral-Derivative (PID) feedback control design with one or more PID algorithms to maintain the desired force, measured by the load cell 188, while the apparatus 820 is in use. A PID controller is a control loop feedback mechanism widely used in industrial control systems, which calculates an error value as the difference between a measured process variable and a desired set point. The controller attempts to minimize the error by adjusting the process through use of a manipulated variable. The embedded PID algorithm directs the remainder of the Drive Controller Software of the main digital controller 880 to preferably vary torque output to minimize the error observed between the measured parameter, preferably assist force, and the set-point, with the ability to adjust said torque up to 10 times per second. The manipulated variable might alternatively be, for example, motor current, absolute cable position or cable velocity or a combination of sensor outputs, which might be combined in the algorithm to compute a new composite output variable. This software would be coded for the specifics of the apparatus. Proprietary software for this type of control system can be provided by various commercial entities such as Regal Beloit America Power Electronics Division of Beloit, Wis.

Again, this non-servo motor type of system is likely to have a slower overall response time as compared with the more expensive servo control platform. The required response time of the control system will be different for the different uses intended for this technology. Response times as short as 100 ms are achievable in such systems (which are twenty times longer than expectations for servo systems). This means control updates and responses occur only ten times per second instead of two hundred. A weight training application may very well be able to tolerate the slower non-servo response time, yet the rehabilitation application may demand the quicker response of the servo. It should be appreciated that a combination of motors might be of different types controlled separately by the controller or by separate controllers. Thus, in FIG. 16, motor 130 might be an inductive motor controlled by a PID algorithm while 330' is a servo motor separately controlled for fine and fast adjustment of the assist force output.

It will be appreciated by those skilled in the art that changes could be made to the embodiments described above without departing from the broad inventive concept thereof. For example, it would be possible to use other types of transmissions for speed reduction between the motor and the reel. However, it is believed that a gear box with fixed speed reduction is the simplest, strongest, and safest form of transmission meeting the needs of the apparatus. While the preferred flexible assist member is a metal cable, it might be another type of cable (polymer or composite) or even a rope or a chain. If desired, connection of the second end 157 of any flexible assist member 156 might be made through a coil spring, hydraulic shock absorber or shock absorbing mechanism.

It should be apparent that other configurations of the same motor, pulley(s), rollers, etc. with or without weights might allow different muscle groups to be so rejuvenated.

It is understood, therefore, that this invention is not limited to the particular embodiments disclosed, but it is intended to cover modifications within the spirit and scope of the present invention.

The invention claimed is:

1. An assist apparatus for delivering an assist force to a human subject at a rehabilitation/therapy exercise station comprising:

a motorized assist assembly including a motor driven reel, the assembly configured to generate a non-zero assist force through the reel;

a flexible assist member having first and second opposing ends, the first end being secured to the reel so as to permit the member to be wound onto and from the reel by operation of the motorized assist assembly;

a harness configured to support the human subject, the harness being operably connected to the second end of the flexible assist member to apply the assist force generated by the motorized assist assembly to a human subject in the harness;

a human-machine interface configured to receive human input of variable parameters for assistance control including entry of at least a user selected non-zero assist force; and a main digital controller operably connected with at least the motorized assist assembly and the human-machine interface, the main digital controller being programmed to automatically convert the user selected non-zero assist force into control signals suitable to operate the motorized assist assembly exclusive of further user input to provide the user selected non-zero assist force through the flexible assist member and harness to at least partially support the weight of the human subject during exercise, wherein the human input of variable parameters comprises at least one of a number of repetitions of the exercise, or differing concentric and eccentric assist forces to be provided during the concentric portion and the eccentric portion of the exercise.

2. The assist apparatus of claim 1 wherein the main digital controller is further configured to send control signals to the motorized assist assembly to provide at the flexible assist member, a non-zero drag force less than the user selected assist force prior to commencement of exercise.

3. The assist apparatus of claim 1 wherein the flexible assist member provides feedback signals to the main digital controller and wherein the main digital controller generates the control signals for the motorized assist assembly at least in part in response to the feedback signals.

4. The assist apparatus of claim 1 further comprising a linear force transducer operably connected with the flexible assist member between the reel and the harness so as to provide to the main digital controller, a signal indicating net assist force being applied by the flexible assist member to the harness.

5. The assist apparatus of claim 1 wherein the station includes a frame over six feet tall and the assist apparatus further comprises a carriage supporting the motorized assist assembly for lateral movement along the top of the frame.

6. The assist apparatus of claim 1 wherein the station includes a frame over six feet tall and the frame is supported for lateral movement on rolling members.

7. The assist apparatus of claim 1 wherein the main digital controller is programmed to control the motorized assist assembly to provide a lesser assist force less than the non-zero assist force alternately with the non-zero assist force for consecutive, predetermined periods of time.

8. A method of operating the assist apparatus of claim 1 comprising the steps of:

initially securing the second end of the flexible assist member with the harness being worn by the user; and thereafter using the motorized assist assembly to apply the assist force to the harness with the user, the assist force being less than the weight of the harness wearing user, so as to assist the user to stand.

9. An assist apparatus for delivering an assist force to user moved weight of an exercise or rehabilitation station comprising:

a motorized assist assembly including first and second motors drivingly connected with a shaft and a reel fixedly supported on the shaft so as to be rotated by the first and second motors;

a flexible assist member having first and second opposing ends, the first end being configured to be secured to the reel so as to permit the member to be wound onto and from the reel by operation of the motorized assist assembly and the second end being configured to be coupled directly or indirectly with the user moved weight;

a human-machine interface configured to receive human input of variable parameters for assistance control including entry of at least a selected non-zero assist force; and a main digital controller operably connected with at least the motorized assist assembly and the human-machine interface, the main digital controller being preprogrammed to convert the user selected non-zero assist force into control signals suitable to simultaneously operate the first and second motors of the motorized assist assembly providing additive forces to provide the user selected non-zero assist force through the flexible assist member during portions of an exercise set having repeated consecutive concentric and eccentric movements.

10. The assist apparatus of claim 9 wherein at least the first motor is a non-servo, AC induction motor having an armature output shaft drivingly coupled with reel.

11. The assist apparatus of claim 9 further comprising:

at least one sensor providing data indicating at least one of position and speed of the armature shaft, rotational position and speed of the reel, current output to operate the motor, torque output by the armature shaft and tension in the flexible assist member; and the main digital controller being operably connected with the at least one sensor to receive the data and being programmed with a Proportional-Integral-Derivative algorithm to control operation of the non-servo AC induction motor in response to the data.

12. The assist apparatus of claim 11 wherein the second motor is a servo motor, smaller in size than the first motor.

13. The assist apparatus of claim 9 wherein at least one of the first and second motors is clutched with the shaft to be selectively disengaged from driving connection with the shaft.

14. The assist apparatus of claim 9 wherein each of the first and second motors is clutched with the shaft to be selectively disengaged from driving connection with the shaft.

15. The assist apparatus of claim 14 wherein each of the first and second motors is a servo motor of equal size.

16. The assist apparatus of claim 9 wherein at least one of the first and second motors has a hollow armature shaft clutched with the shaft to be selectively disengaged from driving connection with the shaft.

17. The assist apparatus according to any one of claims 9 through 16, wherein the apparatus supports at least a portion of a body weight of a user, and the user moved weight comprises at least a portion of the body weight of the user.

18. An assist apparatus for delivering an assist force to a human subject at a rehabilitation/therapy exercise station comprising:

a motorized assist assembly including a motor driven reel, the assembly configured to generate a non-zero assist force through the reel;

a flexible assist member having first and second opposing ends, the first end being secured to the reel so as to permit the member to be wound onto and from the reel by operation of the motorized assist assembly;

a harness configured to support the human subject, the harness being operably connected to the second end of the flexible assist member to apply the assist force generated by the motorized assist assembly to a human subject in the harness;

a human-machine interface configured to receive human input of variable parameters for assistance control including entry of at least a user selected non-zero concentric assist force to be provided during a concentric portion of the exercise and a user selected non-zero eccentric assist force to be provided during an eccentric portion of the exercise; and a main digital controller operably connected with at least the motorized assist assembly and the human-machine interface, the main digital controller being programmed to convert the user selected non-zero concentric and eccentric assist forces into control signals suitable to operate the motorized assist assembly to provide the user selected non-zero concentric and eccentric assist forces through the flexible assist member and harness to at least partially support the weight of the human subject during the concentric and eccentric portions of the exercise.

* * * * *